US009223247B2

(12) United States Patent
Mugita

(10) Patent No.: US 9,223,247 B2
(45) Date of Patent: Dec. 29, 2015

(54) IMAGE FORMING APPARATUS

(71) Applicant: CANON KABUSHIKI KAISHA, Tokyo (JP)

(72) Inventor: Naoki Mugita, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/224,478

(22) Filed: Mar. 25, 2014

(65) Prior Publication Data

US 2014/0294407 A1 Oct. 2, 2014

(30) Foreign Application Priority Data

Mar. 27, 2013 (JP) ..... 2013-066777

(51) Int. Cl.
*G03G 15/08* (2006.01)
*G03G 15/06* (2006.01)
*G03G 15/09* (2006.01)

(52) U.S. Cl.
CPC ..... *G03G 15/0844* (2013.01); *G03G 15/065* (2013.01); *G03G 15/0806* (2013.01); *G03G 15/09* (2013.01); *G03G 15/0907* (2013.01)

(58) Field of Classification Search
CPC ..... G03G 15/065; G03G 15/0806; G03G 15/0844; G03G 15/0907
USPC ..... 399/55, 99, 257
See application file for complete search history.

(56) References Cited

U.S. PATENT DOCUMENTS 5,602,629 A * 2/1997 Saito et al. ..... 399/58
6,868,240 B2 3/2005 Ozawa et al.
7,269,364 B2 9/2007 Tanaka et al.
7,937,008 B2 5/2011 Fujishima et al.
7,957,681 B2 6/2011 Shigehiro
2004/0002015 A1 1/2004 Ozawa et al.
2005/0047832 A1* 3/2005 Hashimoto ..... 399/284
2006/0029405 A1 2/2006 Tanaka et al.
2006/0198644 A1* 9/2006 Itagaki et al. ..... 399/27
2006/0228125 A1* 10/2006 Itagaki et al. ..... 399/55
2008/0206661 A1 8/2008 Fujishima et al.
2010/0247164 A1 9/2010 Shigehiro

FOREIGN PATENT DOCUMENTS

JP 2000-112237 A 4/2000
JP 2005-140802 A 6/2005
JP 2005-331719 A 12/2005
JP 2006-023327 A 1/2006
JP 2006-047651 A 2/2006

(Continued)

*Primary Examiner* — Benjamin Schmitt

(74) *Attorney, Agent, or Firm* — Fitzpatrick, Cella, Harper & Scinto

(57) ABSTRACT

An image forming apparatus includes an image bearing member; a developer storage portion; a developer bearing member; a toner replenishing device that replenishes toner to the developer storage portion; a power supply that supplies an AC voltage or a voltage in which a DC voltage and an AC voltage are superimposed to the developer bearing member at least during an image forming period; and a controller that performs control such that a scattering toner discharge control mode in which the DC voltage only is applied to the developer bearing member in a non-image forming period so as to generate force such that normally charged toner moves from the developer bearing member to the image bearing member so that the toner is discharged from the developer bearing member to the image bearing member.

5 Claims, 25 Drawing Sheets

(56) References Cited

FOREIGN PATENT DOCUMENTS

| | | | |
|---|---|---|---|
| JP | 2008-139400 | A | 6/2008 |
| JP | 2009-204776 | A | 9/2009 |
| JP | 4446713 | B2 | 4/2010 |
| JP | 4517720 | B2 | 8/2010 |
| JP | 4517753 | B2 | 8/2010 |
| JP | 4539220 | B2 | 9/2010 |
| JP | 2010-231017 | A | 10/2010 |
| JP | 5072647 | B2 | 11/2012 |

* cited by examiner

*FIG. 6*

| PRINT RATIO DEPENDENCE OF TONER SCATTERING (BLACK) | | |
|---|---|---|
| PRINT RATIO | 0% | × |
| | 1% | × |
| | 2% | ○ |
| | 3% | ○ |
| | 4% | ○ |
| | 5% | ○ |

*FIG. 8*

| TONER SCATTERING THRESHOLD VIDEO COUNT VALUE Vt | | | |
|---|---|---|---|
| DISCHARGE THRESHOLD (IMAGE Duty %) | | | |
| Y | M | C | K |
| 10 | 10 | 10 | 10 |

*FIG. 12*

| | COLOR | | | |
|---|---|---|---|---|
| | Y | M | C | K |
| PRINT RATIO (%) | 5 | 5 | 5 | 1 |
| VIDEO COUNT VALUE: V | 26 | 26 | 26 | 5 |
| TONER SCATTERING THRESHOLD VIDEO COUNT VALUE: Vt | 10 | 10 | 10 | 10 |
| Vt−V | − 16 | − 16 | − 16 | 5 |
| TONER SCATTERING INTEGRATED VALUE PER SHEET: X | 0 | 0 | 0 | 5 |

*FIG. 16*

| | TONER SCATTERING THRESHOLD VIDEO COUNT VALUE: Vt | | | |
|---|---|---|---|---|
| | DISCHARGE THRESHOLD (IMAGE Duty %) | | | |
| NUMBER OF PRINTOUTS (1,000 PAGES) | Y | M | C | K |
| 0 ~ 100 | 10 | 10 | 10 | 10 |
| 100 ~ 150 | 15 | 15 | 15 | 15 |
| 150 ~ 200 | 20 | 20 | 20 | 20 |
| 200 ~ | 26 | 26 | 26 | 26 |

*FIG. 19*

| | SCATTERING TONER DISCHARGE FREQUENCY: $\alpha$ (%) | | | |
|---|---|---|---|---|
| NUMBER OF PRINTOUTS (1,000 PAGES) | Y | M | C | Bk |
| 0 ~ 100 | 0 | 0 | 0 | 0 |
| 101 ~ 150 | 10 | 10 | 10 | 10 |
| 151 ~ 200 | 25 | 25 | 25 | 25 |
| 201 ~ | 50 | 50 | 50 | 50 |

*FIG. 21*

| | SCATTERING TONER DISCHARGE FREQUENCY: α (%) | | | | | | | | | | | |
|---|---|---|---|---|---|---|---|---|---|---|---|---|
| | Y HUMIDITY (%) | | | M HUMIDITY (%) | | | C HUMIDITY (%) | | | Bk HUMIDITY (%) | | |
| NUMBER OF PRINTOUTS (1,000 PAGES) | 0 ~ 30 | 30 ~ 70 | 71 ~ 100 | 0 ~ 30 | 30 ~ 70 | 71 ~ 100 | 0 ~ 30 | 30 ~ 70 | 71 ~ 100 | 0 ~ 30 | 30 ~ 70 | 71 ~ 100 |
| 0 ~ 50 | 0 | 0 | 0 | 0 | 0 | 0 | 0 | 0 | 0 | 0 | 0 | 0 |
| 50 ~ 100 | 0 | 0 | 10 | 0 | 0 | 10 | 0 | 0 | 10 | 0 | 0 | 10 |
| 101 ~ 150 | 0 | 10 | 25 | 0 | 10 | 25 | 0 | 10 | 25 | 0 | 10 | 25 |
| 151 ~ 200 | 10 | 25 | 50 | 10 | 25 | 50 | 10 | 25 | 50 | 10 | 25 | 50 |
| 201 ~ | 25 | 50 | 50 | 25 | 50 | 50 | 25 | 50 | 50 | 25 | 50 | 50 |

IMAGE FORMING APPARATUS

BACKGROUND OF THE INVENTION

1. Field of the Invention

The present invention relates to an image forming apparatus, such as an electrophotographic copying machine or a laser beam printer, which includes a developing device that develops an electrostatic latent image formed on an image bearing member into a toner image.

2. Description of the Related Art

A magnetic brush developing method that uses a developing sleeve which is a developer bearing member as a two-component magnetic brush developing device is generally used. A developer that includes powder of a magnetic material (for example, a magnetic carrier which is a ferrite) and toner formed by dispersing pigments in a resin, for efficiently developing an electrostatic latent image on a photosensitive drum is agitated and mixed so that charges are held on toner by friction charging due to mutual friction.

This developer is held on a developing sleeve which is a hollow cylindrical developer bearing member made of a non-magnetic material having magnetic poles in the inside thereof. The developing sleeve carries the developer from a developer container to a development area facing the photosensitive drum, and in this development area, the developer is caused to form a magnetic brush by the action of the magnetic field to rub the surface of the photosensitive drum. As a result, the electrostatic latent image formed on the photosensitive drum is developed.

The two-component magnetic brush developing method using this developing sleeve is used in many products such as a monochrome digital copying machine and a full-color copying machine that requires high image quality.

In an image forming apparatus using such a developing device as described above, contamination of the inside of the apparatus due to scattering toner is a problem. When a developer flies between the photosensitive drum and the developing sleeve, toner floats up in the air to become scattering toner. In this case, the scattering toner leaks outside the developing device from upper and lower gaps present between the developing device and the photosensitive drum.

Since an LED, an optical system, and the like, or a transfer unit, a conveying path, and the like are often disposed above or below a development device, various members may malfunction or deteriorate and a toner stain or the like may remain on an output image.

Conventionally, a technique of applying a scattering toner prevention bias is known as a technique of preventing toner from scattering toward the upstream side in the rotation direction of a developing sleeve (Japanese Patent Laid-Open No. 2010-231017 and U.S. Patent Application Publication No. 2010/0247164A1). In this technique, a scattering preventing electrode is disposed so as to prevent toner from scattering from the inside of a developer container. Further, the scattering preventing electrode is disposed vertically above the developing sleeve and closer to the downstream side in the rotation direction of the developing sleeve than a straight line passing the two points which are the center of rotation and the apex of the developing sleeve.

Moreover, Japanese Patent Laid-Open No. 2000-112237 proposes a technique of a scattering toner collecting roller as a technique of preventing toner from scattering toward the lower side of a development device. According to the technique of Japanese Patent Laid-Open No. 2000-112237, the collecting roller is disposed on the downstream side in the rotation direction of a developing sleeve at a position where the developing sleeve makes contact with a photosensitive member.

The collecting roller to which a bias voltage is applied rotates in a reverse direction to the developing sleeve. Toner scattering from a development area is deposited or attracted onto the collecting roller located under the development area. The toner deposited to the collecting roller is conveyed with rotation of the collecting roller and is scraped by a scraper and collected into a developer container. In this manner, the toner scattering from the developing sleeve is prevented from leaking outside the developer container.

Moreover, conventionally, discharge control is performed so that deteriorated toner in the development device is discharged during a non-image forming period. Specifically, toner is discharged to a photosensitive member in a state where a developing bias in which an AC bias and a DC bias are superimposed is applied to a developing sleeve. Moreover, Japanese Patent Laid-Open No. 2008-139400 discloses that discharge control is performed using a DC developing bias.

However, in a developing device including such a scattering preventing bias electrode as described above, an electrode for applying a scattering preventing bias is disposed in a developer container and a high-voltage substrate (or high-voltage rectifier board) for applying a scattering preventing bias is disposed. Thus, there is a problem that the cost and the size of the development device increase.

Moreover, when the conventional deteriorated toner discharge control is performed by a discharge operation based on an AC+DC developing bias, it may be difficult to efficiently discharge toner lumps which become the cause of scattering toner as will be described later.

Thus, when discharging is performed using a DC developing bias only as in Japanese Patent Laid-Open No. 2008-139400, since the discharging is not executed in order to prevent scattering toner, the execution frequency (execution condition) is uniform. Moreover, toner rarely scatters in an initial stage of use. Thus, if the DC discharge control is performed uniformly as in Japanese Patent Laid-Open No. 2008-139400, toner may be consumed unnecessarily.

Moreover, the following problems occur when the discharging operation is performed using a DC developing bias. That is, developing performance decrease as compared to when the discharging operation is performed using an AC developing bias. Thus, the downtime may extend when deteriorated toner other than toner lumps which become the cause of scattering toner is discharged.

Thus, it is desirable to satisfactorily prevent toner scattering while suppressing the downtime and a toner consumption amount with an inexpensive configuration.

SUMMARY OF THE INVENTION

According to an aspect of the present invention, there is provided an image forming apparatus including: an image bearing member; a developing device that includes a developer bearing member rotatably provided so as to carry a developer and that develops an electrostatic latent image formed on the image bearing member; a toner replenishing device that replenishes toner to the developing device; and a controller that is capable of forming an image by applying a voltage in which a DC voltage and an AC voltage are superimposed to the developer bearing member, wherein the controller is capable of executing a first control mode in which the DC voltage only is applied to the developer bearing member during a non-image forming period based on information on a toner consumption amount so that toner moves from the developer bearing member to the image bearing member, the controller is capable of executing a second control mode in which at least the AC voltage is applied to the developer bearing member during the non-image forming period based on the information on the toner consumption amount so that toner moves from the developer bearing member to the image bearing member, and the controller performs control so that at least the first control mode and the second control mode are selectively executed according to information on a number of printouts of a recording material.

Further features of the present invention will become apparent from the following description of exemplary embodiments with reference to the attached drawings.

BRIEF DESCRIPTION OF THE DRAWINGS

FIG. 6 is a table illustrating dependence on print ratio of black toner scattering.

FIG. 8 is a table illustrating toner scattering thresholds of respective colors.

FIG. 12 is a table describing scattering toner discharge control according to Reference Example 1.

FIG. 16 is a table illustrating the thresholds of the progress of toner deterioration of respective colors according to a first embodiment.

FIG. 19 is a table illustrating the number of printouts and a scattering toner discharge frequency according to the third embodiment.

FIG. 21 is a table illustrating humidity, the number of printouts, and a scattering toner discharge frequency according to the fourth embodiment.

DESCRIPTION OF THE EMBODIMENTS

Reference Example 1

An image forming apparatus according to Reference Example 1 will be described in detail.

Figure 1:
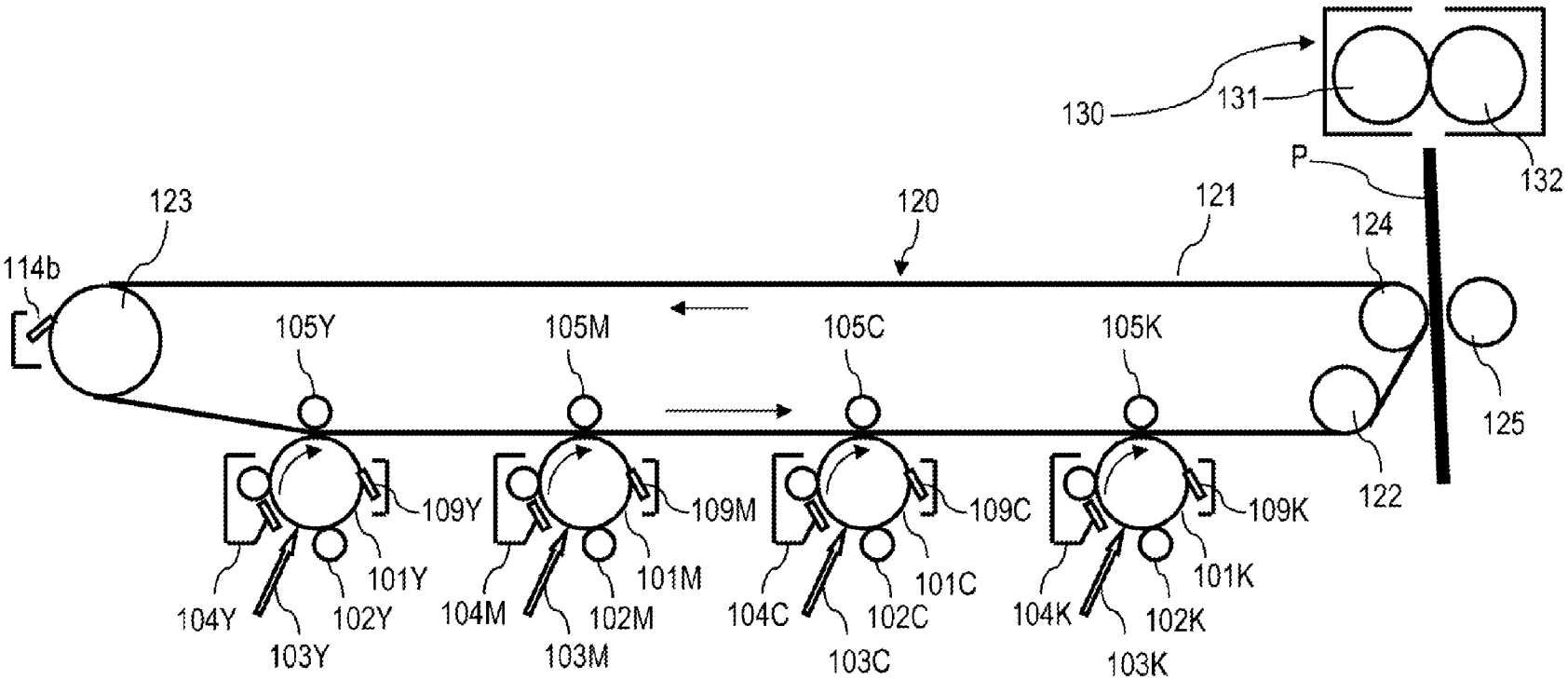
FIG. 1 is a schematic diagram of an image forming apparatus.

<Overview of image forming apparatus to which present invention can be applied> FIG. 1 is a schematic diagram of an image forming apparatus. In the following description, image forming stations form toner images of the respective colors yellow Y, magenta M, cyan C, and black K. Since the respective image forming stations and the devices surrounding the same have the same configuration, the subscripts Y, M, C, and K will not be appropriately presented in the following description.

As illustrated in FIG. 1, an image forming portion of an image forming apparatus to which the present invention can be applied has four image forming stations. The image forming stations respectively have photosensitive drums 101 (101Y, 101M, 101C, and 101K) as image bearing members.

An intermediate transfer device 120 is disposed above each image forming station. The intermediate transfer device 120 is configured so that an intermediate transfer belt (intermediate transfer member) 121 rotates in a direction indicated by arrow by being stretched around rollers 122, 123, and 124.

Upon an image forming operation, first, the surface of the photosensitive drum 101 is charged by a primary charging device 102 (102Y, 102M, 102C, or 102K) that uses a contact charging roller. Subsequently, the surface of the photosensitive drum 101 is exposed to light by a laser 103 (103Y, 103M, 103C, or 103K) that is irradiated by an exposure device under the control of a laser driver (not illustrated). In this way, an electrostatic latent image is formed on the photosensitive drum 101.

The electrostatic latent image is developed by a development device 104 (104Y, 104M, 104C, or 104K). In this way, toner images of yellow, magenta, cyan, and black are formed.

The toner images formed in the respective image forming stations are transferred and superimposed on the intermediate transfer belt 121 formed of a polyimide-based resin according to a transfer bias formed by a primary transfer roller 105 (105Y, 105M, 105C, or 105K; primary transfer member).

The toner images of four colors formed on the intermediate transfer belt 121 are transferred to a recording material P by a secondary transfer roller (secondary transfer member) 125 that is disposed to face the roller 124. A residual toner remaining on the intermediate transfer belt 121 without being transferred to the recording material P is removed by an intermediate transfer belt cleaner 114*b*.

The recording material P to which the toner image is transferred is pressed and heated by a fixing device 130 including a pressing roller 131 and a heating roller 132 whereby a permanent image is obtained. Moreover, a primary transfer residual toner remaining on the photosensitive drum 101 after the primary transfer process is removed by a cleaning blade contacting cleaner 109 (109Y, 109M, 109C, or 109K) to be prepared for the next image forming operation.

Figure 2:
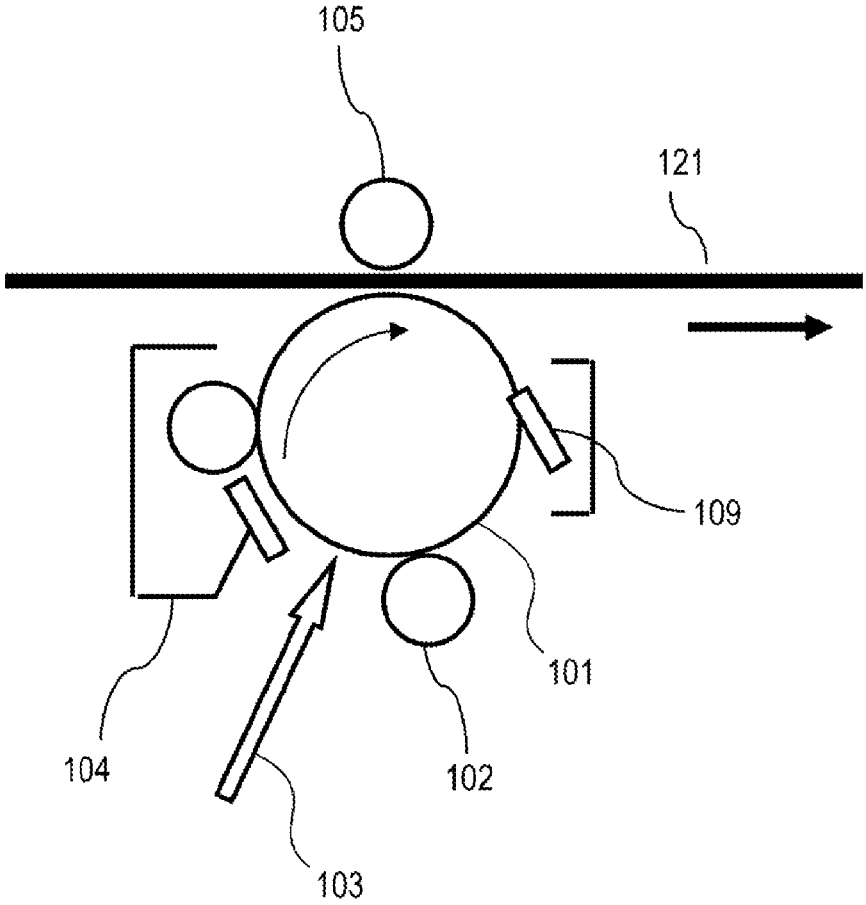
FIG. 2 is a schematic diagram around a photosensitive drum of the image forming apparatus.

<Configuration surrounding photosensitive drum of image forming apparatus> FIG. 2 is a schematic configuration around a photosensitive drum of the image forming apparatus. Referring to FIG. 2, the configuration around the photosensitive drum 101 will be described in detail.

As illustrated in FIG. 2, the image forming station includes the primary charging device 102, a space to which the laser 103 is irradiated, the development device 104, and the cleaner 109 which are located around the photosensitive drum 101. Moreover, the primary transfer roller 105 is disposed with the intermediate transfer belt 121 interposed.

Figure 3:
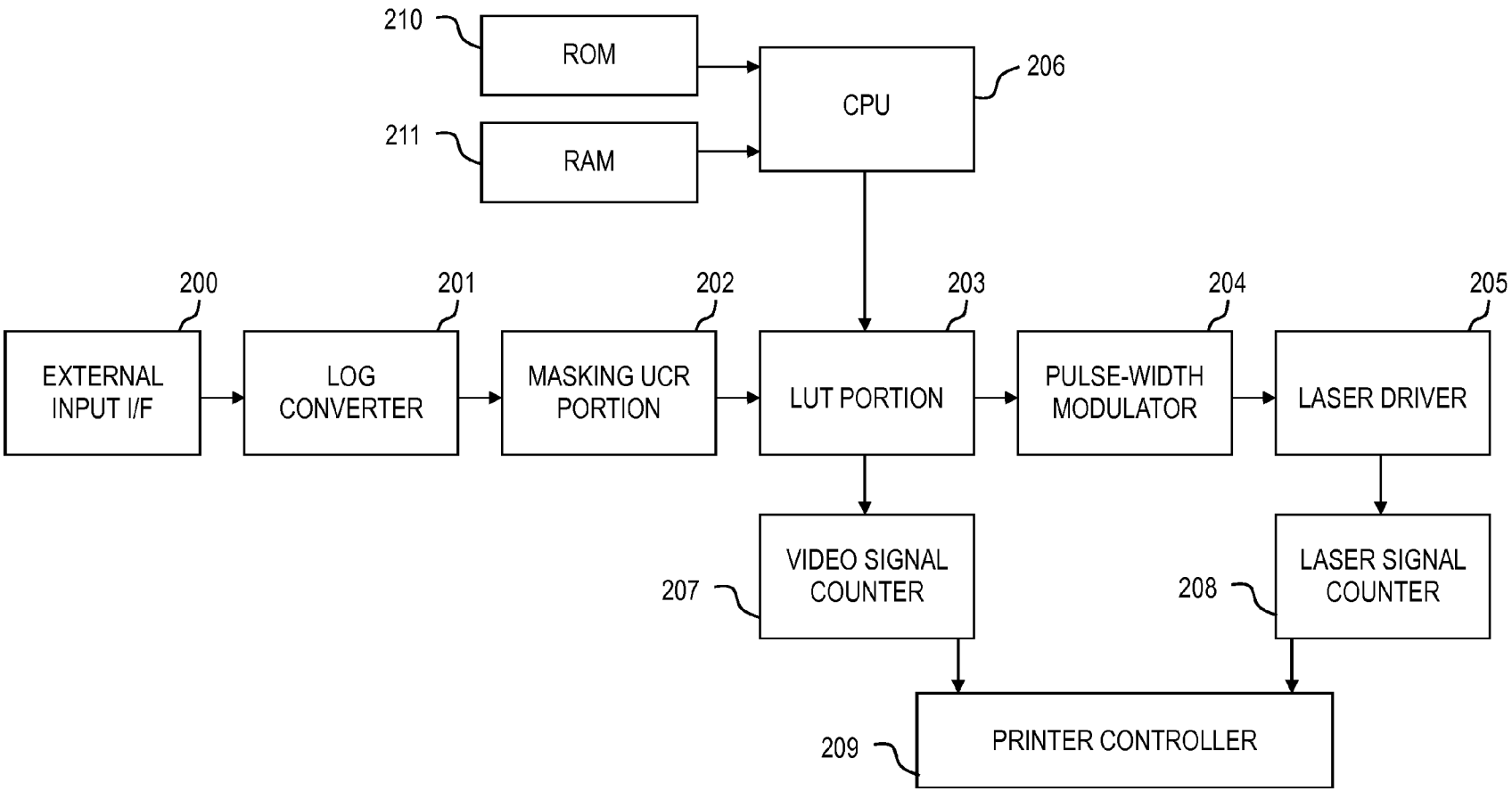
FIG. 3 is a block diagram illustrating a system configuration of an image processing unit.

<Overview of image processing> Next, a system configuration of an image processing unit of the image forming apparatus according to the present embodiment will be described. FIG. 3 is a block diagram illustrating a system configuration of an image processing unit.

As illustrated in FIG. 3, color image data is input from an external input interface (external input I/F) 200. The color image data is input from an external apparatus (not illustrated) such as a document scanner or a computer (information processing apparatus) as RGB image data as necessary.

A LOG conversion portion 201 converts luminance data of the input RGB image data to CMY density data (CMY image data) based on a lookup table (LUT) constructed by data and the like stored in a ROM 210.

A masking and UCR portion 202 extracts black (Bk) component data from the CMY image data and applies a matrix operation to the CMYK image data in order to correct the degree of muddiness of a recording color material.

A LUT portion (lookup table portion) 203 applies density correction of each color to the input CMYK image data using a gamma lookup table (γ-lookup table) in order to allow the image data to match ideal gradation characteristics of a printer portion. The γ-lookup table is created based on data expanded onto a RAM 211 and the table contents are set by a CPU 206.

A pulse-width modulation portion 204 outputs a pulse signal having a pulse width corresponding to a level of the image data (image signal) input from the LUT portion 203. The laser driver 205 drives a light emitting element of the laser 103 based on the pulse signal so as to irradiate the photosensitive drum 101, whereby an electrostatic latent image is formed.

A video signal counting portion 207 integrates the level (0 to 255 level) of each pixel corresponding to one image area at 600 dpi of the image data input to the LUT portion 203. This integrated value of the image data is referred to as a video count value. The video count value amounts to its largest value of 1023 when all surfaces of an output image have 255 level. When there is a limit on the circuit configuration, the image signal from the laser driver 205 is calculated in the same manner using a laser signal counting portion 208 instead of the video signal counting portion 207. In this manner, it is possible to obtain the video count value.

A printer controller 209 control respective portions of the image forming apparatus based on the information obtained from the video signal counting portion 207 or the laser signal counting portion 208.

Figure 4:
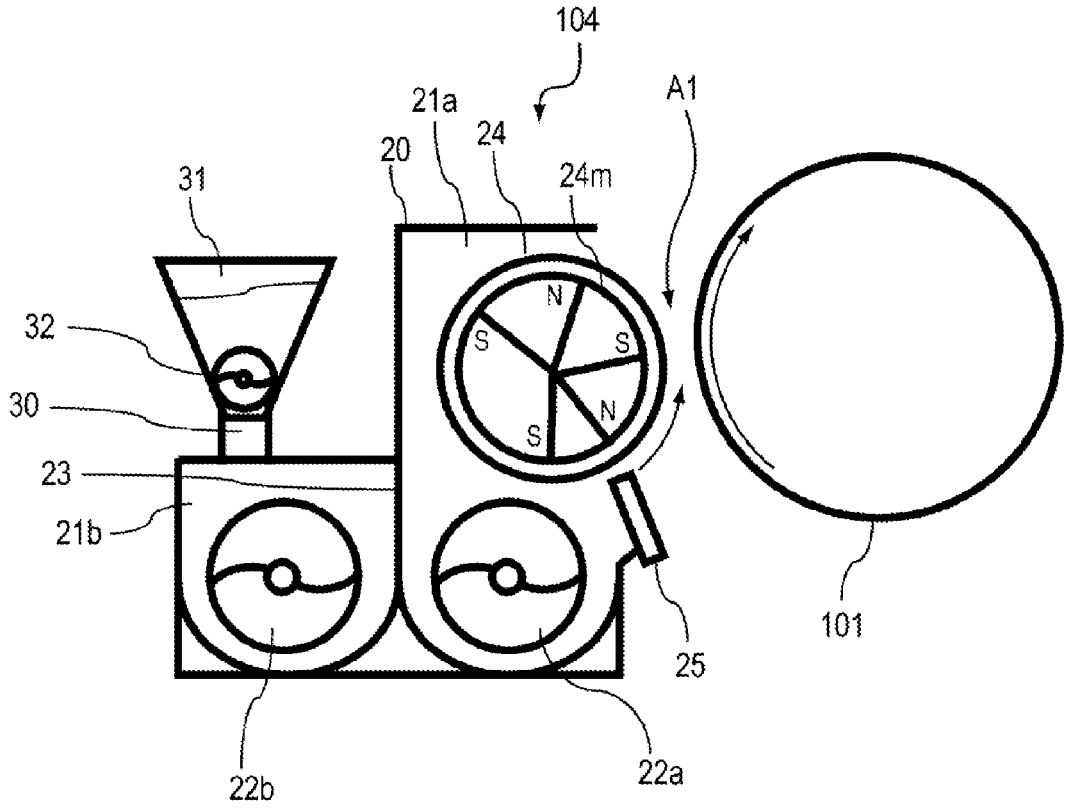
FIG. 4 is a schematic cross-sectional view of a development device.
Figure 5:
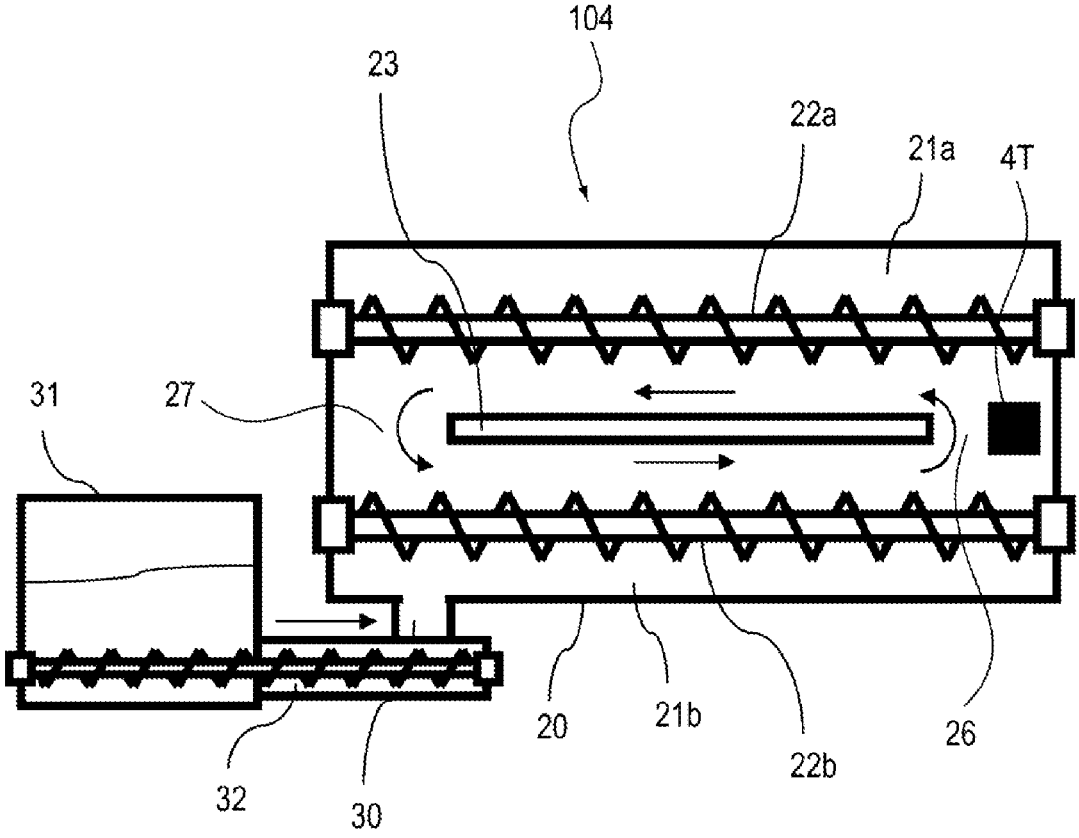
FIG. 5 is a schematic longitudinal diagram of the development device.

<Configuration of development device> Next, the development device 104 will be described in detail. FIG. 4 is a schematic cross-sectional view of a development device. FIG. 5 is a schematic longitudinal diagram of the development device.

As illustrated in FIGS. 4 and 5, the development device 104 includes a developer container (developer storage portion) 20 and a two-component developer that includes toner and a carrier as a developer is stored in the developer container 20. A developing sleeve (developer bearing member) 24 and a regulating blade (brush trimming member) 25 that regulates the magnetic brush of the developer carried on the developing sleeve 24 are disposed in the developer container 20.

The inside of the developer container 20 is partitioned in the horizontal direction into a developing chamber 21*a* and an agitating chamber 21*b* on the left and right sides by a partition wall 23 of which approximately the central portion extends in a vertical direction of the drawing sheet. The developer is stored in the developing chamber 21*a* and the agitating chamber 21*b*.

A first agitation screw 22*a* and a second agitation screw 22*b* which are conveying members as developer agitation and conveying members are disposed in the developing chamber 21*a* and the agitating chamber 21*b*, respectively.

The first agitation screw 22*a* is disposed at the bottom of the developing chamber 21*a* so as to be substantially in parallel along the axial direction of the developing sleeve 24. When the first agitation screw 22*a* rotates, the developer in the developing chamber 21*a* is conveyed in one direction along the axial direction.

The second agitation screw 22*b* is disposed at the bottom of the agitating chamber 21*b* so as to be substantially in parallel to the first agitation screw 22*a*. The second agitation screw 22*b* conveys the developer in the agitating chamber 21*b* in an opposite direction to the first agitation screw 22*a*.

In this manner, with the conveyance by the rotation of the first agitation screw 22*a* and the second agitation screw 22*b*, the developer circulates between the developing chamber 21*a* and the agitating chamber 21*b* through a communicating portion 26 and a communicating portion 27 (see FIG. 5) formed at both ends of the partition wall 23.

Although the developing chamber 21*a* and the agitating chamber 21*b* are disposed on the left and right sides in the horizontal direction, the present invention can be applied to a development device (developing device) in which the developing chamber 21*a* and the agitating chamber 21*b* are disposed on the upper and lower sides and a development device having another configuration.

An opening is formed at a position corresponding to a development area A1 (see FIG. 4) facing the photosensitive drum 101 of the developer container 20, and the developing sleeve 24 is rotatably arranged in the opening so that a portion thereof is exposed in the direction of the photosensitive drum 101.

In the present embodiment, a diameter of the developing sleeve 24 is 20 mm, a diameter of the photosensitive drum 101 is 30 mm, and the closest area between the developing sleeve 24 and the photosensitive drum 101 is approximately 300 μm. Due to this configuration, development can be performed in a state where the developer conveyed to the development area A1 is in contact with the photosensitive drum 101. The developing sleeve 24 is formed of a nonmagnetic material such as aluminum or stainless steel and a magnet roller 24*m* which is a magnetic portion is provided therein in a non-rotatable state.

<Operation of development device> In the above configuration, the developing sleeve 24 rotates in a direction indicated by arrow (counter-clockwise direction) during development and carries a two-component developer of which the thickness is regulated by the trimming of the magnetic brush by the regulating blade 25. The developing sleeve 24 conveys the thickness-regulated developer to the development area A1 facing the photosensitive drum 101 and supplies the developer to the electrostatic latent image formed in an image portion of the photosensitive drum 101 to thereby perform development.

In this case, in order to improve development efficiency (efficiency of applying toner to an electrostatic latent image), a developing bias voltage in which a DC voltage and an AC voltage are superimposed is applied from a power supply to the developing sleeve 24. In the present embodiment, a DC voltage of −500 V and an AC voltage having a peak-to-peak voltage Vpp of 1800 V and a frequency f of 12 KHz are used. However, the DC voltage value and the AC voltage waveform are not limited to this.

In general, in a two-component magnetic brush development method, if an AC voltage is applied, development efficiency increases and images have high quality whereas fogging is likely to occur. Thus, a potential difference is provided between the DC voltage applied to the developing sleeve 24 and a charging potential (that is, a blank portion potential) of the photosensitive drum 101. In this way, fogging is prevented.

The regulating blade 25 is formed as a planar nonmagnetic member formed of such as plate-shaped aluminum, extending along the longitudinal axial direction of the developing sleeve 24. Moreover, the regulating blade 25 is arranged closer to the upstream side in the rotation direction of the developing sleeve than the photosensitive drum 101. Both the toner and the carrier of the developer pass between the distal end of the regulating blade 25 and the developing sleeve 24 and are conveyed to the development area A1.

By adjusting the gap between the regulating blade 25 and the surface of the developing sleeve 24, the trimming amount of the developer magnetic brush carried on the developing sleeve 24 is regulated and the developer amount conveyed to the development area is adjusted. In the present embodiment, a developer coating amount per unit area of the developing sleeve 24 is regulated to 30 mg/cm$^2$ by the regulating blade 25.

The gap between the regulating blade 25 and the developing sleeve 24 is set to 200 μm to 1000 μm, and preferably 300 μm to 700 μm. In the present embodiment, the gap is set to 500 μm.

Moreover, in the development area A1, the developing sleeve 24 moves in a forward direction in relation to the moving direction of the photosensitive drum 101 and moves at a peripheral speed ratio of 1.80 in relation to the photosensitive drum 101. The peripheral speed ratio is set between 0 and 3.0 and is optional if it is set between 0.5 and 2.0. Although the development efficiency increases if the moving velocity ratio increases, since problems such as toner scattering or developer deterioration may occur if the ratio is too large, the ratio is set within the above range.

<Method of replenishing developer of development device> Next, a developer replenishment method of the present embodiment will be described with reference to FIGS. 4 and 5.

A hopper (toner replenishing portion) 31 that stores a two-component replenishment developer (generally, a toner-to-replenishment developer ratio is 100% to 80%) in which toner and carrier are mixed is disposed above the development device 104. The hopper 31 includes a screw-shaped replenishment screw (replenishment member) 32 at its bottom, and one end of the replenishment screw 32 extends up to the position of a developer replenishment port 30 that is formed at the rear end of the development device 104.

An amount of toner consumed by the image forming operation passes from the hopper 31 through the developer replenishment port 30 by the rotational force of the replenishment screw 32 and the gravity acting on the developer and is supplied into the developer container 20.

The amount of replenishment developer supplied from the hopper 31 to the development device 104 is roughly determined by the number of rotations of the replenishment screw 32. This number of rotations is determined by a toner replenishment amount controller (not illustrated) based on the video count value of the image data, the detection results of a toner density detecting portion (not illustrated) provided in the developer container 20, and the like.

<Overview of developer stored in development device> The two-component developer made up of toner and carrier stored in the developer container 20 of the development device 104 will be described in detail.

The toner contains a binder resin and colorants, and if necessary, coloring resin particles containing other additives and coloring particles to which external additives such as fine powder of colloidal silica are externally added. The toner is a negatively charged polyester-based resin, and a volume average particle diameter is preferably 4 μm or more and 10 μm or smaller. More preferably, the volume average particle diameter is 8 μm or smaller.

In recent years, in order to improve fixing properties, toner having a low melting point or toner having a low glass transition temperature (Tg) (for example, Tg≤70° C.) is often used. Further, in order to improve separability after fixing, wax is sometimes contained in toner.

Examples of the carrier include metals such as surface-oxidized or unoxidized iron, nickel, cobalt, manganese, chromium, or rare-earth metal, an alloy thereof, and ferrite oxide, which are preferably used. A method of manufacturing these magnetic particles is not particularly limited. The carrier has a weight average particle diameter of 20 μm to 60 μm and preferably 30 μm to 50 μm, and the resistivity thereof is $10^7$ Ωcm or more, and preferably, $10^8$ Ωcm or more. In the present embodiment, the carrier having resistivity of $10^8$ Ωcm is used.

The volume average particle diameter of the toner used in the present embodiment is measured using the following device and method. A sheath flow electric-resistance type particle diameter distribution measurement apparatus SD-2000 (product of Sysmex Corporation) is used as a measurement apparatus.

The measurement method is as follows. More specifically, a surfactant as a dispersant, preferably 0.1 ml of alkyl benzene sulfonate is added, and 0.5 to 50 mg of measurement sample is added, to 100 to 150 ml of electrolytic aqueous solution of 1% NaCl aqueous solution prepared using primary sodium chloride. The electrolytic aqueous solution in which samples are suspended is subjected to dispersion processing for about 1 to 3 minutes by an ultrasonic dispersion device. Then, the particle diameter distribution of particles of 2 to 40 μm is measured to determine a volume average distribution using a 100 μm aperture as an aperture, by the sheath flow electric-resistance type particle diameter distribution measurement apparatus SD-2000. The volume average particle diameter is obtained from the volume average distribution determined in this way.

A resistivity of the carrier used in the present embodiment is measured using a sandwich-type cell in which a measuring electrode area is 4 cm and spacing between electrodes is 0.4 cm. The resistivity of the carrier is measured according to a method of obtaining a resistivity of the carrier from an electric current which flows through a circuit, upon applying a voltage E (V/cm) between both electrodes with pressure of a weight of 1 kg applied to one electrode.

<Control method of scattering toner discharge control mode> A method of controlling the operation in a scattering toner discharge control mode which is a characteristic portion of the present embodiment will be described in detail. Here, in a scattering toner discharge control mode, during a non-image forming period, only a DC voltage is applied to the developing sleeve 24 so that force is applied in such a manner that a normally charged toner moves from the developing sleeve 24 to the photosensitive drum 101. In this way, the toner is discharged from the developing sleeve 24 to the photosensitive drum 101.

The non-image forming period includes a standby operation period before and after an image forming operation starts actually after an image forming signal instructing to form an image on a recording material is received and the time when during execution of a continuous image forming operation, a region corresponding to the position between sheets passes through a development position which is a portion where the drum and the developing sleeve face each other. Moreover, an image forming period includes a developing operation period when a latent image is developed to form an image on a recording material.

In the present embodiment, the potentials of respective members are set as follows. First, during a normal image forming period, a non-image-portion drum potential is set to −600 V, a development potential is set to −450 V (AC+DC), and an image-portion drum potential is set to −450 V to −250 V. A development contrast at a largest image density is set to 200 V.

On the other hand, in a scattering toner discharge control mode, the non-image-portion drum potential is changed from −600 V to −200 V during discharging, the development potential is set to −450 V (DC), and the polarity of the normally charged toner is set to negative. That is, although the development contrast during discharging is 250 V which is larger than the development contrast during the normal image forming period, the present invention is not limited to this, and the development contrast during discharging may be set to be equal to or smaller than the development contrast during the normal image forming period.

In an image forming apparatus, when an image having a low print ratio is continuously formed, the proportion of toner moving from the developer container 20 to the photosensitive drum 101 is small. Thus, for a long period, the toner in the developer container 20 is subjected to agitation of the first and second agitation screws 22*a* and 22*b* and friction when the toner passes through the regulating blade 25.

As a result, the external additives of the toner may peel off or the external additives may be embedded in the toner surface, and the exposure of the resin surface of the toner may be remarkable. When the external additives disappear from the toner surface, the binding force between toners becomes strong and toner lumps are generated.

When the generated toner lumps in the developer container 20 are flipped up by the first agitation screw 22*a* to reach the development area A1 by being carried on the developing sleeve 24, the toner lumps may scatter into the image forming apparatus as scattering toner with a higher probability than normal toner.

This is attributable to the following reasons. A toner lump has a large volume (the diameter thereof is approximately 20 to 35 μm whereas the diameter of normal toner is approximately 6 μm) and has a large mass. Due to this, when the toner lump reaches the development area A1, the toner lump receives strong centrifugal force due to rotation of the developing sleeve 24. As a result, the toner lump is more likely to scatter as compared to normal toner.

Thus, in the present embodiment, when an image having a low print ratio is continuously formed, the toner lumps stored in the developer container 20 are selectively discharged to a non-image portion of the photosensitive drum 101 with the aid of the developing sleeve 24 before the toner lumps scatter into the image forming apparatus. Moreover, the image forming apparatus has a scattering toner discharge control mode in which the toner lumps discharged onto the photosensitive drum 101 are collected by the cleaner 109. The scattering toner discharge control mode can be executed by a controller.

Specifically, in the present embodiment, a developing bias of a predetermined DC voltage is applied to the developing sleeve 24. In this way, control is performed so that the toner lumps are selectively discharged onto the photosensitive drum 101.

In the following description of the present embodiment, first, the fact that the occurrence rate of toner lumps and a toner scattering level are different depending on an image print ratio and how a scattering toner discharge control mode will be executed depending on the print ratio will be described.

<Relationship between occurrence of toner lumps and scattering toner amount depending on image print ratio> As described above, when the proportion of toner moving to the photosensitive drum 101 is small and the amount of toner supplied to the developer container 20 is small (when the print ratio is low), toner deterioration progresses and toner lumps are generated. Therefore, the present inventors conducted the following experiment.

Specifically, the development device 104 was installed under a certain constant environment (temperature 23° C. and relative humidity 50%), and an image was continuously formed on one side of 10,000 pages of A4-size sheet while changing the print ratio (0% to 5%) of the respective YMCK colors. A change in the scattering toner amount in the development device after a continuous image forming operation was performed was examined.

The scattering toner amount was measured in the following manner. First, in the development device 104, a plain paper for measurement was wound to cover the development area A1. The developing sleeve 24 and the first and second agitation screws 22*a* and 22*b* were caused to perform idle rotation for a predetermined period (1 minute). The amount of toner scattered and adhered to the plain paper for measurement in the period was observed by an optical microscope and image analysis was performed.

The results of the experiment are as follows. FIG. 6 is a table illustrating dependence on print ratio of black toner scattering. In FIG. 6, "○" indicates that a scattering toner amount is equal to or smaller than a target value, and "x" indicates that the scattering toner amount exceeds the target value. The target value in the present embodiment is equal to or smaller than 3000 particles/minute in the measurement method described above.

Figure 7:
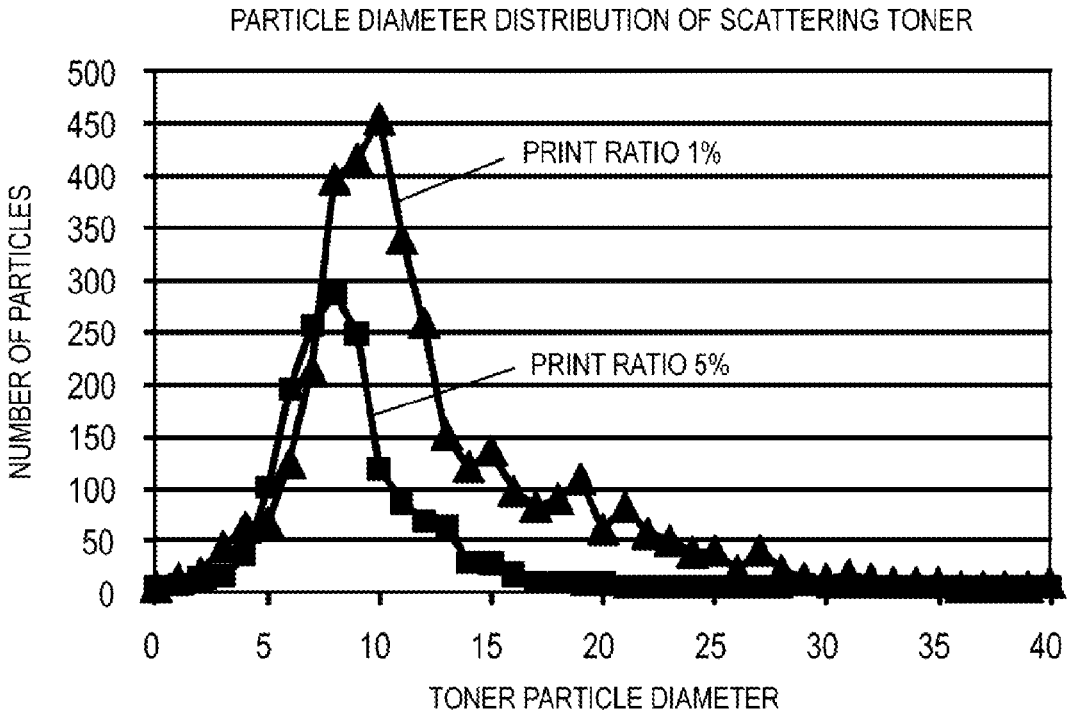
FIG. 7 is a graph illustrating a particle diameter distribution of scattering toners having print ratios of 1% and 5%.

FIG. 7 is a graph illustrating a particle diameter distribution of scattering toners having print ratios of 1% and 5%. The horizontal axis represents a toner particle diameter measured by image analysis and the vertical axis represents the number of particles having the corresponding particle diameter.

According to the graph of FIG. 7, it can be understood that a developer of which the print ratio is deteriorated to 1% has a large scattering toner amount, the particle diameter distribution thereof is shifted to a large particle diameter side, and toner lumps having a diameter of approximately 20 to 35 μm are generated. When the toner adhered to the plain paper for scattering toner amount measurement was actually observed with an optical microscope, a number of toner lumps were visible.

From the experiment results of FIGS. 6 and 7, it was understood that the lower the print ratio, the more the toner lumps are likely to occur, and the more the toner lumps are likely to scatter due to idle rotation. In other words, in the image forming apparatus of the present embodiment, the scattering due to toner lumps gets worse unless an image forming operation of a certain print ratio or more (that is, a certain video count value or more) is executed.

Thus, in the present embodiment, the following control is performed in order to prevent the deterioration of scattering due to toner lumps. First, a video count value corresponding to a smallest necessary toner consumption amount is defined as a "toner scattering threshold video count value Vt." This value can be calculated by the experiment described above.

FIG. 8 is a table illustrating toner scattering threshold video count values of respective colors. The toner scattering threshold video count value Vt may be calculated appropriately because the value is different depending on the color and the material of the developer (toner and carrier), the configuration of the development device, and the like.

<Operation condition of scattering toner discharge control mode> Next, an operation condition of the scattering toner discharge control mode will be described. The control idea of the scattering toner discharge control mode is the same for respective colors. Thus, although the description of colors may not be presented in the following flowcharts and the like, in that case, the same control is performed for the respective colors.

Figure 9:
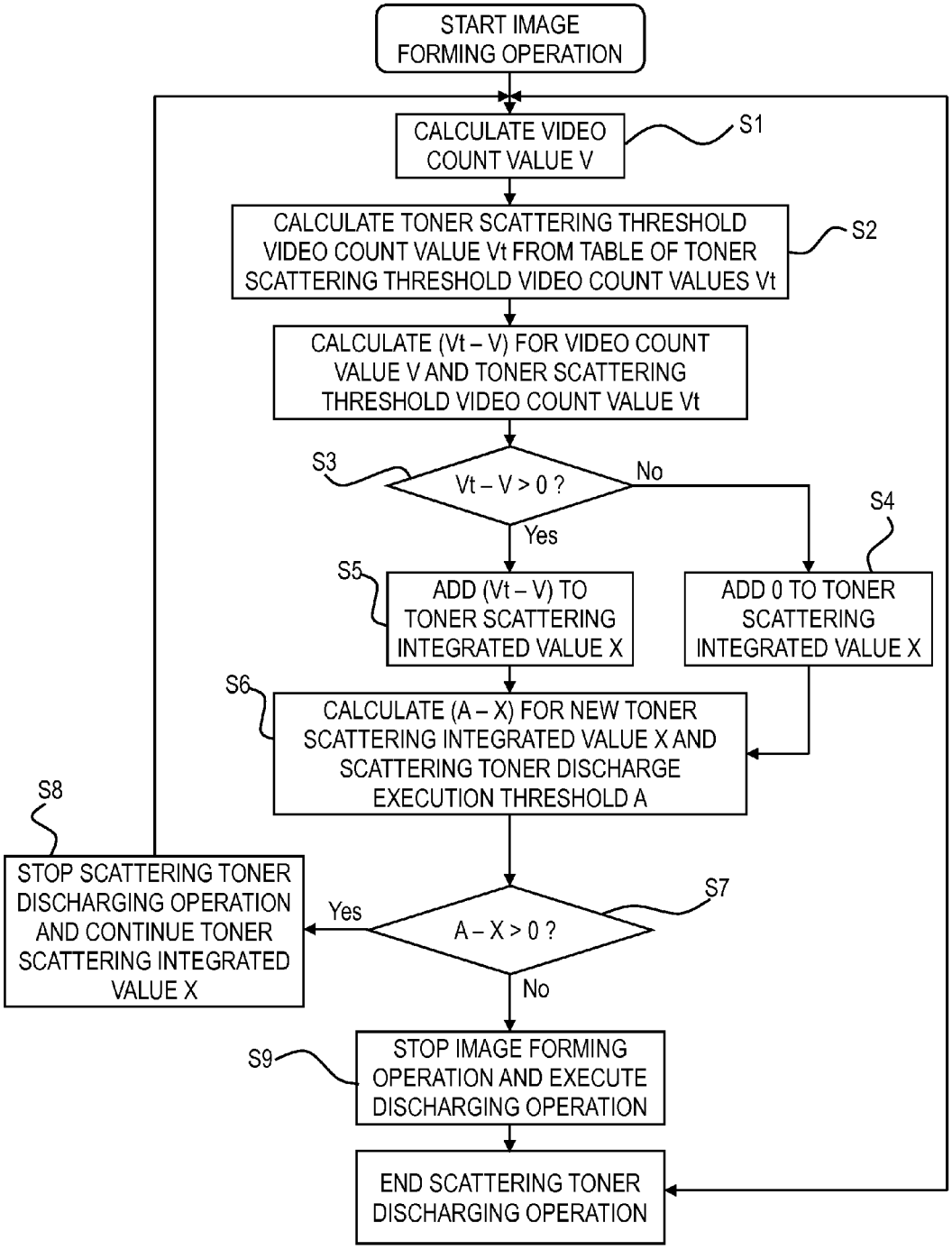
FIG. 9 is a flowchart of scattering toner discharge control according to Reference Example 1.

In the present embodiment, as a simple example, a case where an image (hereinafter referred to as a "black low-duty image chart") of which the print ratios per sheet of the respective YMCK colors are 5% for Y, 5% for M, 5% for C, and 1% for K is continuously formed on A4-size sheet is considered. The toner discharge control in this case will be described with reference to the flowchart illustrated in FIG. 9. FIG. 9 is a flowchart of scattering toner discharge control according to Reference Example 1.

When an image forming operation starts, the video signal counting portion 207 (see FIG. 3) calculates the video count values V(Y), V(M), V(C), and V(K) of respective colors (step S1).

In the present embodiment, the video count value of an entire surface solid image (an image having a print ratio of 100%) on one surface of A4-size sheet for a certain color is 512. The video count values of the "black low-duty image chart" are V(Y)=26, V(M)=26, V(C)=26 and V(K)=5. Here, when each video count is calculated, the fractional portion of the number is rounded off to the nearest integer.

Subsequently, the toner scattering threshold video count value Vt is calculated from the table (see FIG. 8) of the toner scattering threshold video count values Vt obtained by the experiment described above (step S2).

Subsequently, the sign (positive or negative) of the difference (Vt−V) between the video count value V and the toner scattering threshold video count value Vt is determined (step S3).

When (Vt−V) is negative, since the print ratio is high, the toner is in a state in which no toner lump is generated and toner scattering due to toner lumps does not progress. Thus, "0" is added to a toner scattering integrated value X (step S4). Here, the toner scattering integrated value X is an index indicating a current toner scattering state due to toner lumps and is an integrated value of the video count value calculated by (Vt−V).

On the other hand, when (Vt−V) is positive, since the print ratio is low, the toner is in a state in which toner lumps are generated and toner scattering due to toner lumps progresses. Thus, (Vt−V) is added to the toner scattering integrated value X (step S5).

Further, a difference (A−X) between a scattering toner discharge execution threshold A and the toner scattering integrated value X calculated and updated every image forming operation in the above steps is calculated (step S6). Here, the scattering toner discharge execution threshold A is a predetermined value that can be set optionally. The smaller the scattering toner discharge execution threshold A is, the higher the frequency of execution of a scattering toner discharge control operation becomes even in the continuous image forming operation at the same print ratio.

In the present embodiment, the scattering toner discharge execution threshold A is set to 512. If the set value of the scattering toner discharge execution threshold A is too large, the period in which the toner lumps scatter into the image forming apparatus before a scattering toner discharging operation is executed increases. Thus, the scattering toner discharge execution threshold A is preferably set to be approximately equal to the video count value of the entire surface solid image (the image having the print ratio of 100%) on one surface of A4 or A3-size sheets. Moreover, for example, there is a tendency that the larger the volume of the developer that can be stored in the developer container 20 is, the larger the scattering toner discharge execution threshold A that can be set is.

Finally, the sign (positive or negative) of a difference (A−X) between the toner scattering integrated value X and the scattering toner discharge execution threshold A calculated in step S6 is determined (step S7).

When (A−X) is positive, it is determined that the occurrence of toner lumps has not progressed as much as scattering toner has to be discharged immediately and an image forming operation is continued (step S8).

On the other hand, when (A−X) is negative, it is determined that it is necessary to discharge scattering toner immediately because the occurrence of toner lumps has progressed sufficiently, and the image forming operation is stopped and a scattering toner discharging operation is executed (step S9).

Figure 10:
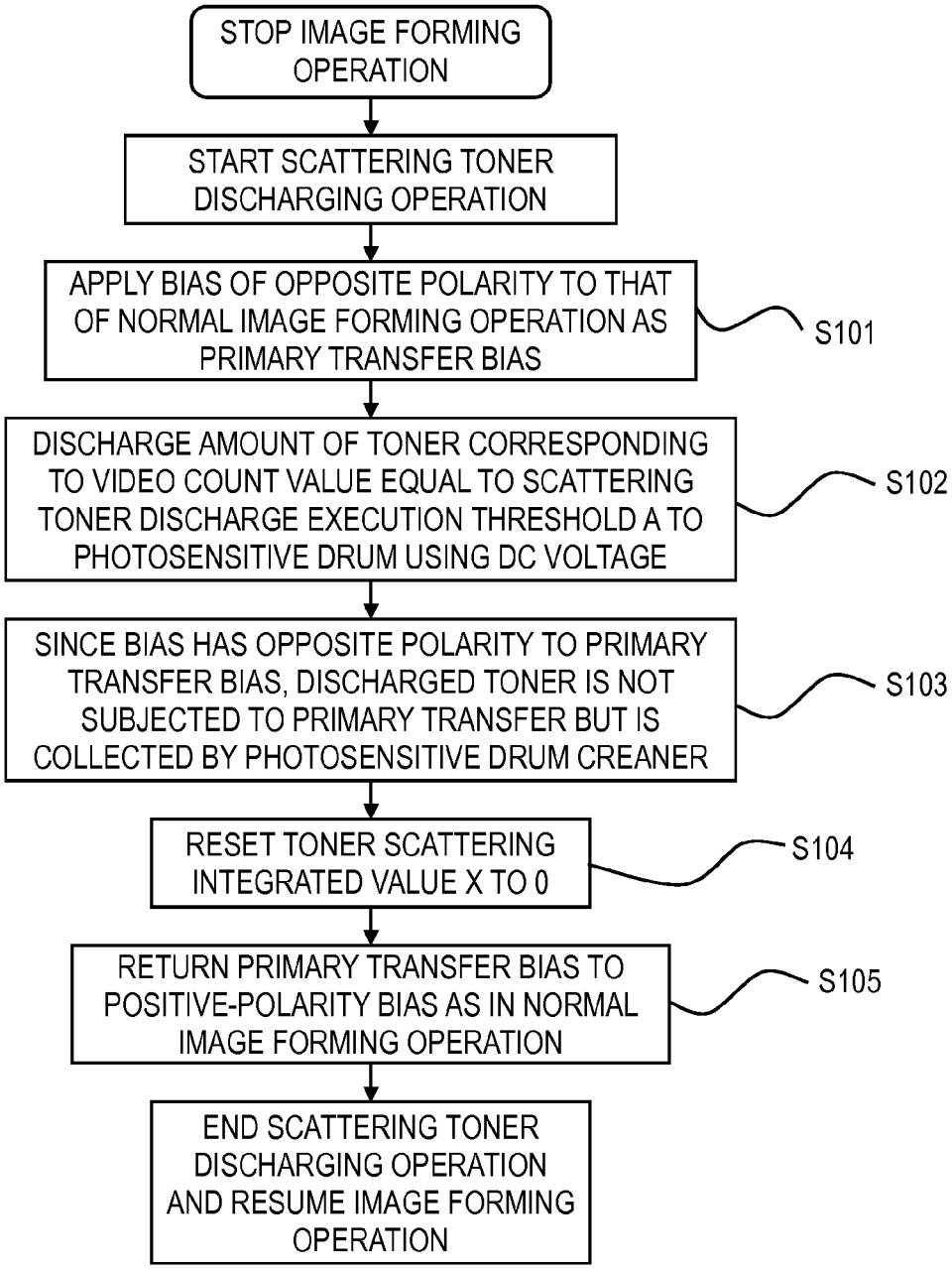
FIG. 10 is a flowchart of scattering toner discharge control according to Reference Example 1.

Here, the scattering toner discharging operation will be described with reference to FIG. 10. FIG. 10 is a flowchart of the scattering toner discharge control according to Reference Example 1. In FIG. 10, steps associated with the scattering toner discharging operation will be described.

When it is determined in step S7 that (A−X) has a negative value, the image forming operation is stopped and a scattering toner discharging operation is executed.

First, a transfer bias of an opposite-polarity to that of the normal image forming operation (that is, a transfer bias of the same polarity as the toner image on the photosensitive drum) is applied as the primary transfer bias (step S101).

Subsequently, an amount of toner corresponding to the video count value of the scattering toner discharge execution threshold A is discharged to a non-image portion of the photosensitive drum 101 (step S102).

If an entire surface solid image has 255 level, the electrostatic latent image on the photosensitive drum 101 for toner discharging is desirably a half-tone latent image of which the level is approximately ½ of the solid image. As a more important point, the developing bias applied to the developing sleeve 24 during the scattering toner discharging operation needs to be a DC voltage.

This is because according to the experiment of the present inventors, it was found that the manner in which a toner lump generated by an image forming operation with a low print ratio is developed on the photosensitive drum 101 is different depending on the type of the developing bias applied to the developing sleeve 24.

Figure 11:
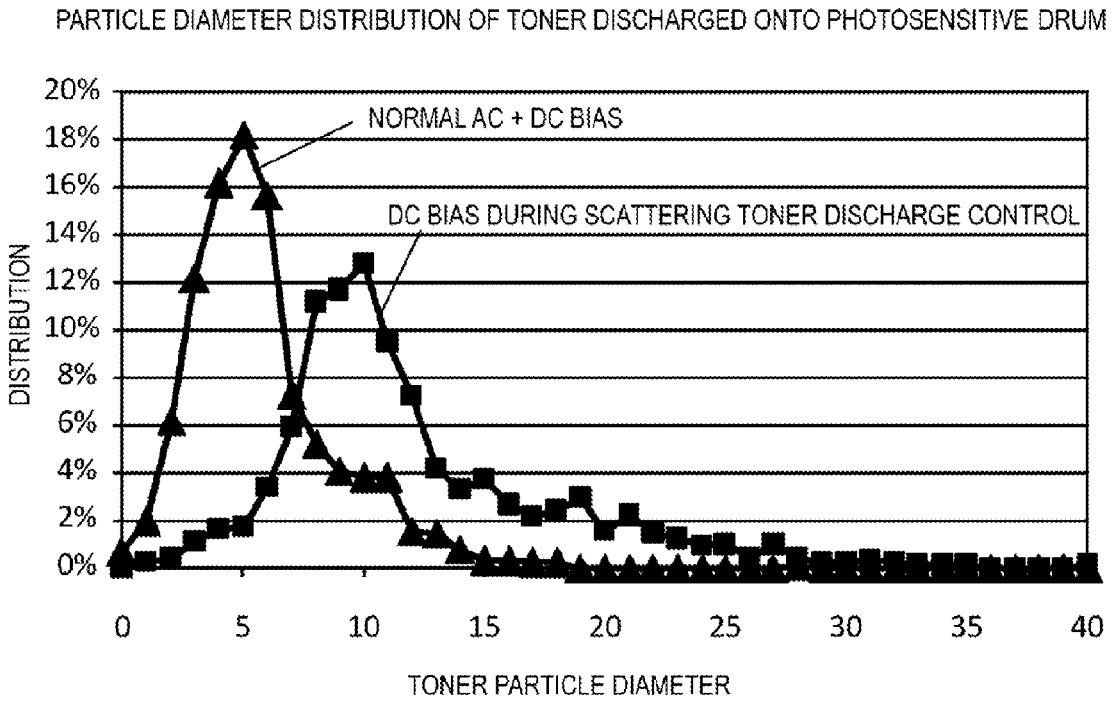
FIG. 11 is a graph illustrating a particle diameter distribution of toner discharged by the scattering toner discharge control according to Reference Example 1.

FIG. 11 illustrates a particle diameter distribution of the toner discharged by the scattering toner discharge control according to Reference Example 1. Specifically, FIG. 11 illustrates a particle diameter distribution of the toner developed on the photosensitive drum 101 when a developer deteriorated by 10,000 printouts with a print ratio of 1% was developed using various developing biases.

As illustrated in FIG. 11, a case where an electrostatic latent image lighter than that of a normal image forming operation is developed using a DC voltage is compared with a case where the electrostatic latent image is developed using a normal developing bias in which a DC voltage and an AC voltage are superimposed. It was found that toner lumps having a diameter of 20 to 35 μm can be selectively developed when the electrostatic latent image lighter than that of the normal image forming operation was developed using a DC voltage. Thus, the developing bias during the scattering toner discharging operation is preferably the DC voltage unlike during the normal image forming operation.

Returning to FIG. 10, since the primary transfer bias has the same polarity as the toner, the toner discharged onto the photosensitive drum 101 is not transferred to the intermediate transfer belt 121 but is collected by the cleaner 109 of the photosensitive drum 101 (step S103).

Here, the toner scattering integrated value X is reset to "0" (step S104). Finally, the primary transfer bias is changed to a bias having the polarity of the normal image forming operation (step S105) to complete the scattering toner discharging operation, and the normal image forming operation is resumed.

Here, in the scattering toner discharge control method described above, a case where the "black low-duty image chart" is continuously formed on 10,000 pages of sheet will be described specifically.

First, when the "black low-duty image chart" is formed on one page of sheet, how the toner scattering integrated value X is calculated for each color in the scattering toner discharge control of the present embodiment is illustrated in the table of FIG. 12. FIG. 12 is a table describing the scattering toner discharge control according to Reference Example 1.

As illustrated in FIG. 12, when the "black low-duty image chart" is formed, since the print ratios of Y (yellow), M (magenta), and C (cyan) are always sufficiently high, the toner scattering integrated value X is always "0".

On the other hand, since the print ratio of K (black) is low, the toner scattering integrated value X per page is +5. That is, it means that the occurrence of toner lumps of black toner progresses during a continuous image forming operation.

More specifically, when the "black low-duty image chart" is continuously formed on 10,000 pages of A4-size sheet, since the toner scattering integrated value X per sheet is +5, scattering toner discharging is executed. The execution frequency is every 512/5=103 pages (rounded up to the nearest integer) because the scattering toner discharge execution threshold A is 512.

Figure 13:
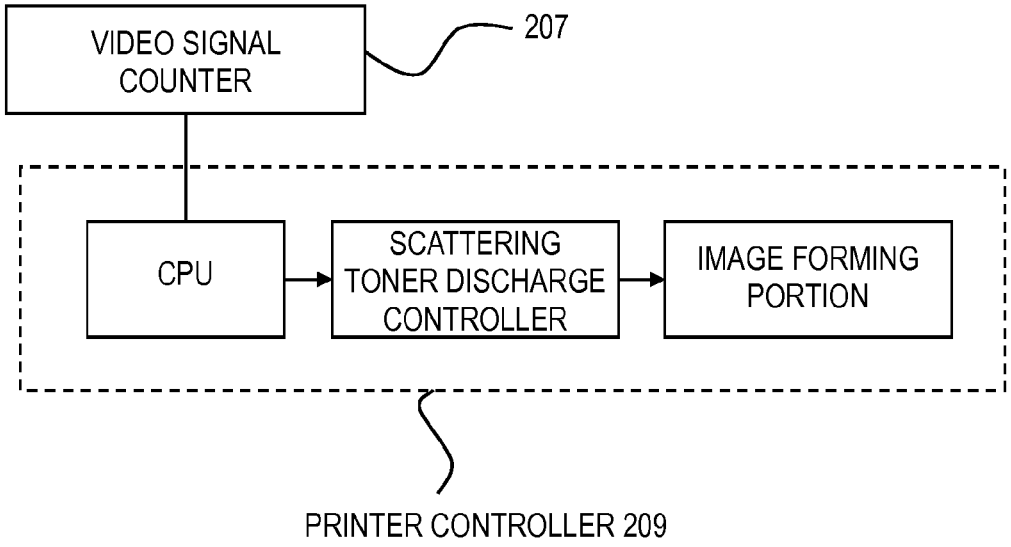
FIG. 13 is a conceptual diagram illustrating control blocks associated with the scattering toner discharge control according to Reference Example 1.

A simple procedure of the above-described control is illustrated in FIG. 13. FIG. 13 is a conceptual diagram illustrating control blocks associated with the scattering toner discharge control according to Reference Example 1.

As illustrated in FIG. 13, the video count values measured by the video signal counting portion 207 are transmitted to the printer controller 209 (see FIG. 3), and a CPU executes the scattering toner discharge control described in the flowcharts of FIGS. 9 and 10 to instruct the image forming portion to execute the scattering toner discharging operation.

In the present embodiment, when the "black low-duty image chart" is continuously formed on 10,000 pages of A4-size sheet, the image forming operation is stopped to execute scattering toner discharging approximately 97 times. One scattering toner discharging operation consumes an amount of toner corresponding to 1/10 of the video count value 512. Moreover, in order to selectively discharge toner lumps which become the cause of scattering during the scattering toner discharge control mode, a DC voltage different from that of the normal image forming operation is applied to the developing sleeve. With this operation, it is possible to suppress the scattering toner amount.

First Embodiment

An image forming apparatus according to a first embodiment will be described in detail. The same constituent components as those described above will be denoted by the same reference numerals, and the description thereof will not be provided.

Figure 14:
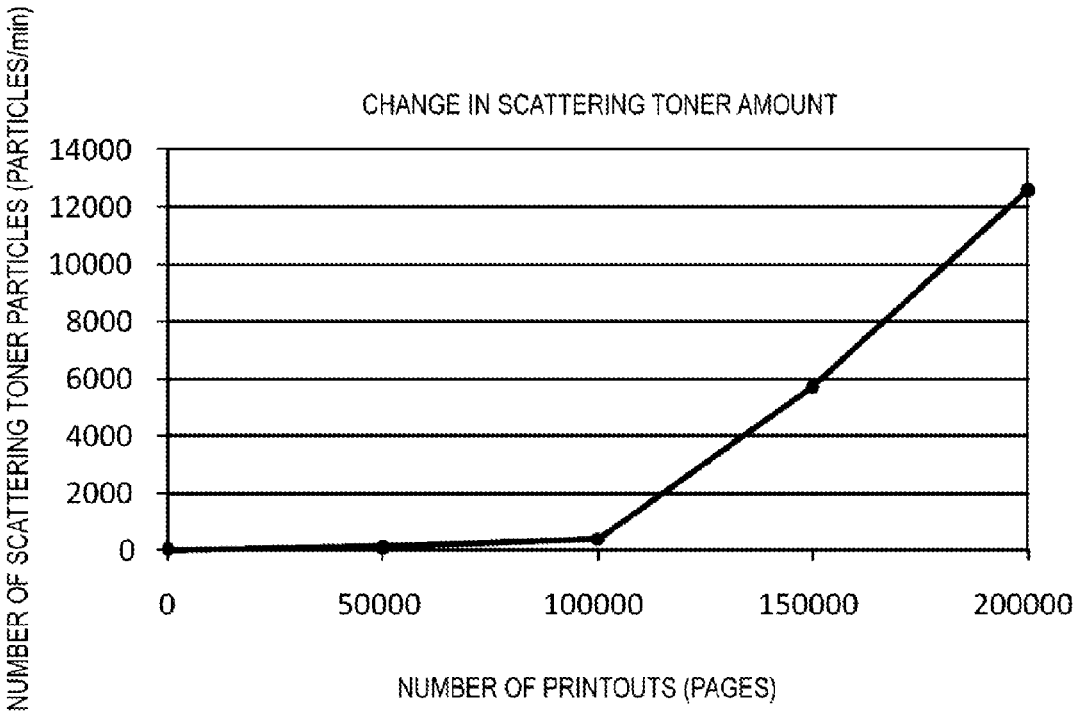
FIG. 14 is a graph illustrating a change in a scattering toner amount due to deterioration.

FIG. 14 is a graph illustrating a change in the scattering toner amount due to deterioration. Specifically, FIG. 14 illustrates a change in the scattering toner amount when scattering toner (toner lump) discharge control was not performed but an image having the duty of 5% was formed on 200,000 pages of sheet.

As illustrated in FIG. 14, the scattering toner amount increases with an increase in the number of printouts, and approximately 12,700 toner particles have scattered in one minute after deterioration of 200,000 printouts. In particular, it can be understood that when the number of printouts exceeds 100,000 pages of sheet, the scattering toner increases abruptly. This is because when the number of printouts increases, toner adheres to carrier, the charge applying performance of the carrier decreases, and the adhering force of the toner and carrier decreases.

An air particle sizer (APS; APS3321, product of U.S. TSI Corporation) was used for measurement of the scattering toner amount. The APS can inhale air to accelerate particles contained therein and calculate the particle diameter from the speed to measure the particle diameter and the number of particles present in gas. The APS can detect the particle diameter up to 20 μm on the μm order and is ideal for detecting toner having a particle diameter distribution of 2 to 10 μm.

Figure 15:
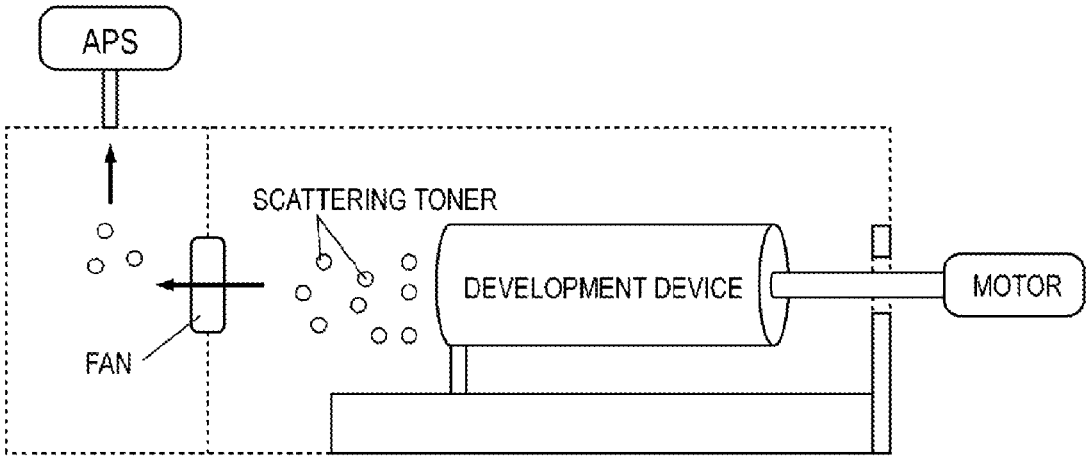
FIG. 15 is a schematic diagram illustrating a configuration associated with scattering toner measurement.

FIG. 15 is a schematic diagram illustrating a configuration associated with scattering toner amount measurement. When the amount of scattering toner from the development device 104 is measured, the development device 104 is set on a jig that can rotate the development device 104 only as illustrated in FIG. 15, the space thereof is covered except for an air passage hole, and a fan is provided therein so that air can flow stably.

In this state, the development device was caused to perform idle rotation for a predetermined period, the APS was caused to continuously inhale air through the output port at the same time, and the amount and particle diameter of the toner scattering from the development device 104 per unit time were measured. In this case, in order to inhale all scattering toners, the measurement was continued until the amount of air inhaled by the APS reached approximately 0 after the development device 104 stopped idle rotation.

Here, in an initial stage of deterioration where the scattering toner amount is small, even when the scattering toner discharge control according to Reference Example 1 was performed, a large effect of reducing the scattering toner amount was not obtained, and the toner consumption amount increased.

Thus, in the first embodiment, the toner scattering threshold video count values Vt of the scattering toner discharge control mode was changed according to the number of printouts. FIG. 16 is a table illustrating the thresholds of the progress of toner deterioration of respective colors according to the first embodiment.

As a pre-condition, the control idea of the scattering toner discharge control mode is the same for the respective colors. Thus, it should be understood that the same control is performed for the respective colors when the description of colors is not presented in the following flowcharts and the like.

In the first embodiment, in order to simplify the description, a case where the "black low-duty image chart" of which the print ratios per sheet of the respective YMCK colors are 5% for Y, 5% for M, 5% for C, and 1% for K is continuously formed on A4-size sheet is considered.

Figure 17:
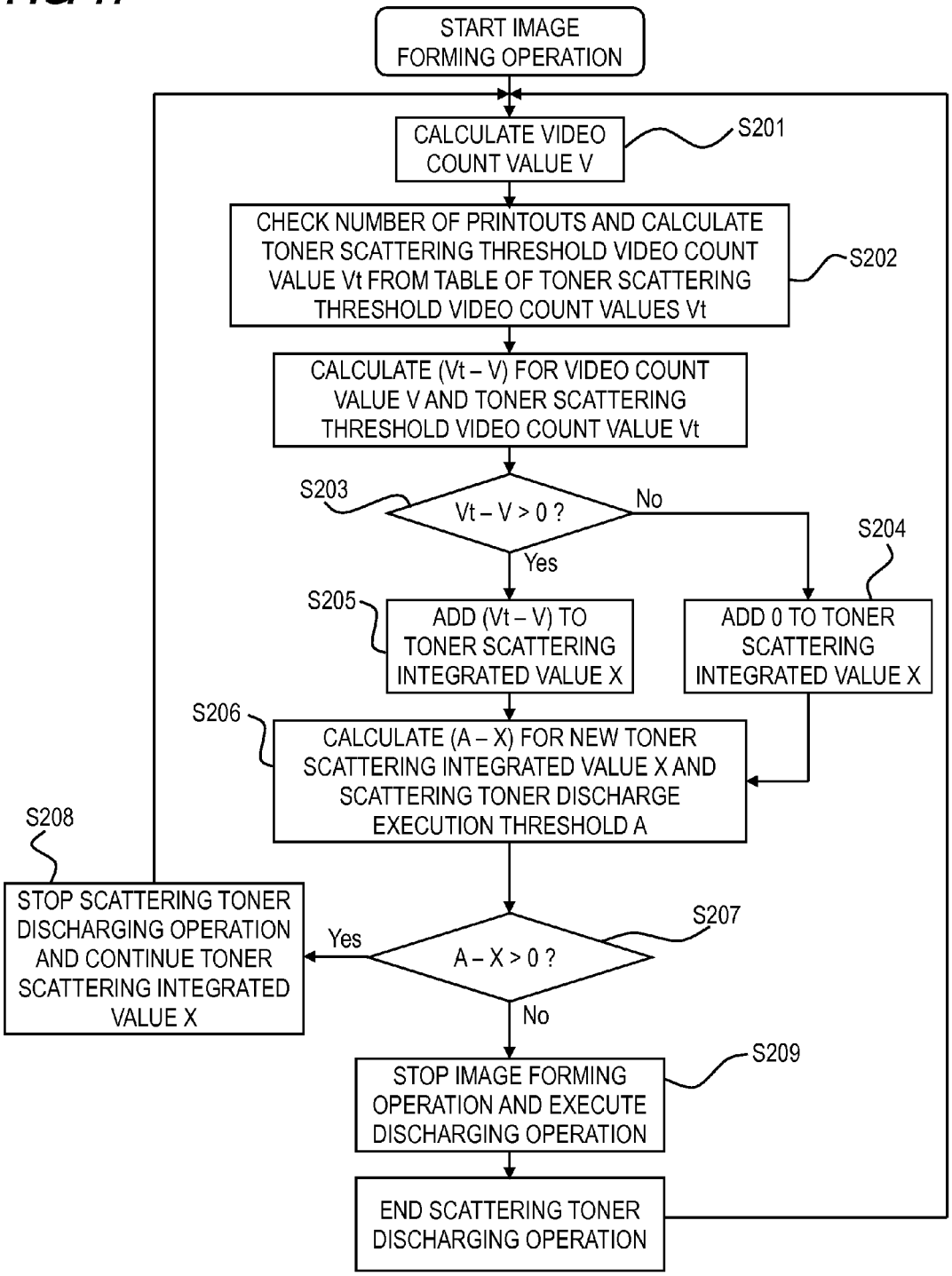
FIG. 17 is a flowchart of toner discharge control according to the first embodiment.

The scattering toner discharge control mode in this case will be described with reference to the flowchart to be illustrated below. FIG. 17 is a flowchart of toner discharge control according to the first embodiment.

First, when an image forming operation starts, the video signal counting portion 207 calculates the video count values V(Y), V(M), V(C), and V(K) of respective colors (step S201). Subsequently, the toner scattering threshold video count value Vt is calculated from the table (see FIG. 16) of the toner scattering threshold video count values Vt obtained by the experiment described above and the number of printouts (step S202). After that, the toner discharge control is performed similarly to Reference Example 1 according to the toner scattering threshold video count value Vt (steps S203 to S209).

From the above, in the present embodiment, it is possible to suppress the scattering toner amount even when the number of printouts increases and the adhering force between the toner and carrier decreases.

In the present embodiment, although an example of changing the toner scattering threshold video count values Vt according to the number of printouts has been described, the present invention is not limited to this. For example, information correlated with the number of printouts may be used as a substitute. For example, the driving period of the main apparatus, the driving period of the developing sleeve, and a developing bias application period may be used as a substitute.

Second Embodiment

An image forming apparatus according to a second embodiment will be described in detail. The same constituent components as those described above will be denoted by the same reference numerals, and the description thereof will not be provided.

In the above embodiment, the scattering toner discharge control has been described. However, an actual image forming apparatus may have a "deteriorated toner discharge control mode" in which deteriorated toner is discharged using the same developing bias as that of a normal image forming operation when the print ratio is low.

For example, Japanese Patent Laid-Open No. 2006-023327 proposes a control method of suppressing a decrease in productivity as much as possible while preventing a deterioration in image quality. Specifically, when a value which indicates the amount of the toner used for each image forming operation (for example, a video count value for each image forming operation) is smaller than a predetermined threshold, a difference thereof is calculated. When an integrated value obtained by integrating the calculated difference reaches a predetermined value, the deteriorated toner discharge control mode is executed.

In the present embodiment, the potentials of respective members are set as follows. First, during a normal image forming period, a non-image-portion drum potential is set to −600 V, a development potential is set to −450 V (AC+DC), and an image-portion drum potential is set to −450 V to −250 V.

On the other hand, in a scattering toner discharge control mode, the non-image-portion drum potential is changed from −600 V to −200 V during discharging, the development potential is set to −450 V (DC), and the polarity of the normally charged toner is set to negative. Further, in the deteriorated toner discharge control mode, the non-image-portion drum potential is changed from −600 V to −250 V during discharging, the development potential is set to −450 V (DC+AC), and the polarity of the normally charged toner is set to negative. The present embodiment has two toner discharge control modes and changes the latent image potential according to the discharge mode so that the amount of discharged toner becomes constant.

In the present embodiment, although the latent image potential is changed according to the discharge mode, the present invention is not limited to this but can be applied to a developing device in which a discharge period is changed rather than changing the latent image potential so that the amount of discharged toner becomes constant.

The amount of discharged toner may not be the same for the two toner discharge control modes.

In this way, it is possible to appropriately set the threshold of the amount of the toner consumed by the image forming operation and the threshold of the difference integrated value for determining whether or not to execute the deteriorated toner discharge control mode. By doing so, the deteriorated toner discharge control mode is prevented from being executed immediately before the image quality (roughness and granularity) decreases due to toner deterioration. On the other hand, the deteriorated toner discharge control mode can be executed immediately when the image quality deteriorates. That is, it is possible to perform control such that a decrease in productivity is suppressed as much as possible while preventing a deterioration in the image quality.

In an image forming apparatus having the deteriorated toner discharge control mode described above, toner lumps are accumulated and toner scattering gets worse if the image forming apparatus does not have the same "scattering toner (toner lump) discharge control mode" as Reference Example 1. Thus, in the second embodiment, the scattering toner discharge control mode is introduced to the image forming apparatus having the deteriorated toner discharge control mode described above. In this way, it is possible to improve the scattering level.

Moreover, in the present embodiment, the deteriorated toner discharge control mode is performed using a normal developing bias in which a DC voltage and an AC voltage are superimposed as in the image forming operation. In this case, it is possible to discharge scattering toner although the amount is small as compared to the scattering toner discharge control mode.

Thus, in the present embodiment, the deteriorated toner discharge control mode only is executed when the number of printouts is small and the scattering toner amount is small, and the scattering toner discharge control mode is selectively performed using the DC voltage only when the number of printouts increases and toner can scatter easily.

<Control method of toner discharge control mode> First, as a pre-condition, the control idea of the toner discharge control mode is the same for the respective colors. Thus, although the description of colors may be not presented in the following flowcharts and the like, in that case, the same control is performed for the respective colors. In the second embodiment, in order to simplify the description, a case where the "black low-duty image chart" of which the print ratios per sheet of the respective YMCK colors are 5% for Y, 5% for M, 5% for C, and 1% for K is continuously formed on A4-size sheet is considered.

In the present embodiment, the number of printouts of 100,000 pages at which the scattering toner amount increases greatly in FIG. 14 is used as a threshold. The deteriorated toner discharge control mode only is performed when the number of printouts is equal to or smaller than 100,000 pages, and the scattering toner discharge control mode using the DC voltage only as well as the deteriorated toner discharge control mode is selectively performed when the number of printouts exceeds 100,000 pages.

Figure 18:
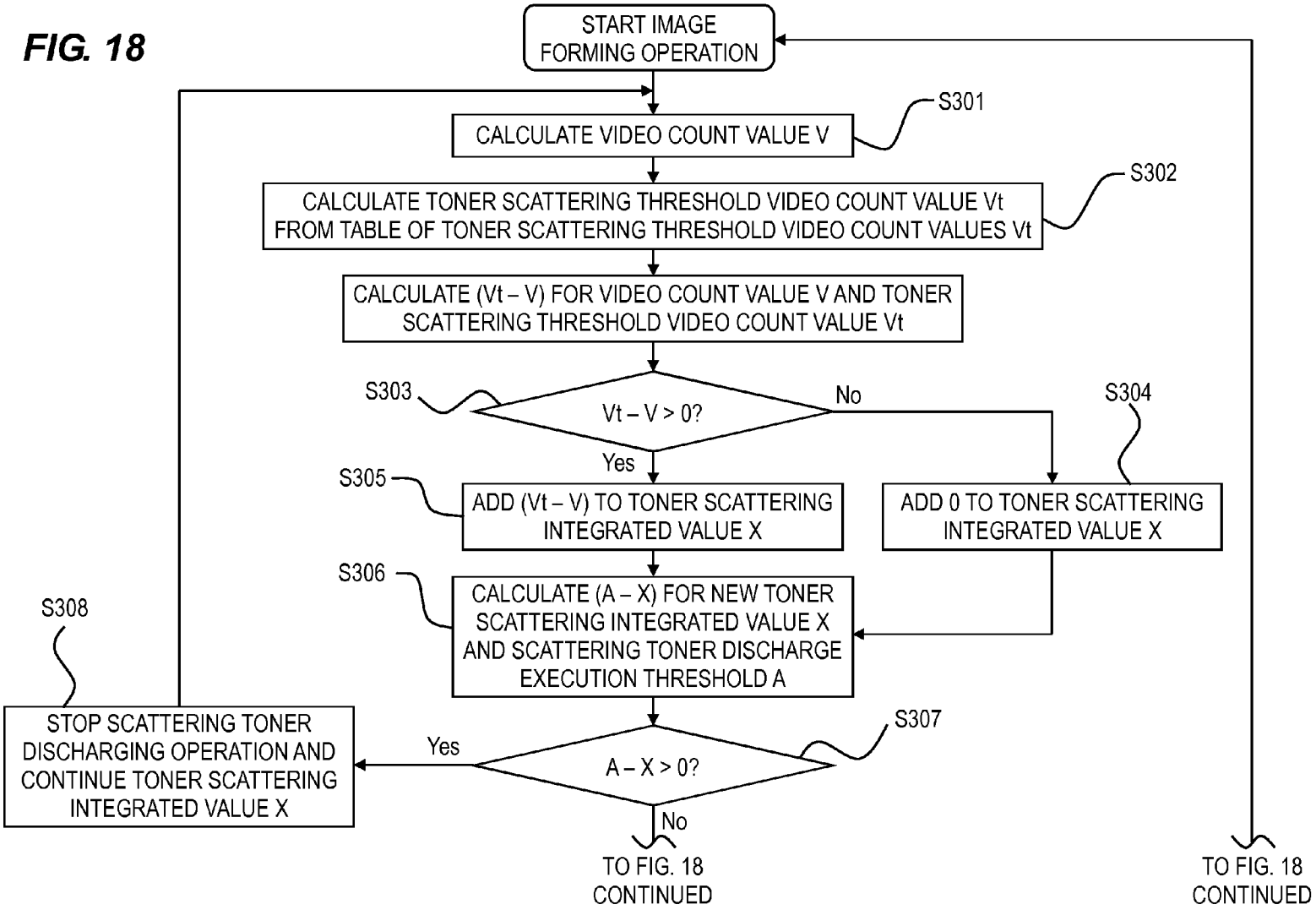
FIG. 18 is a flowchart of toner discharge control according to a second embodiment.
Figure 18:
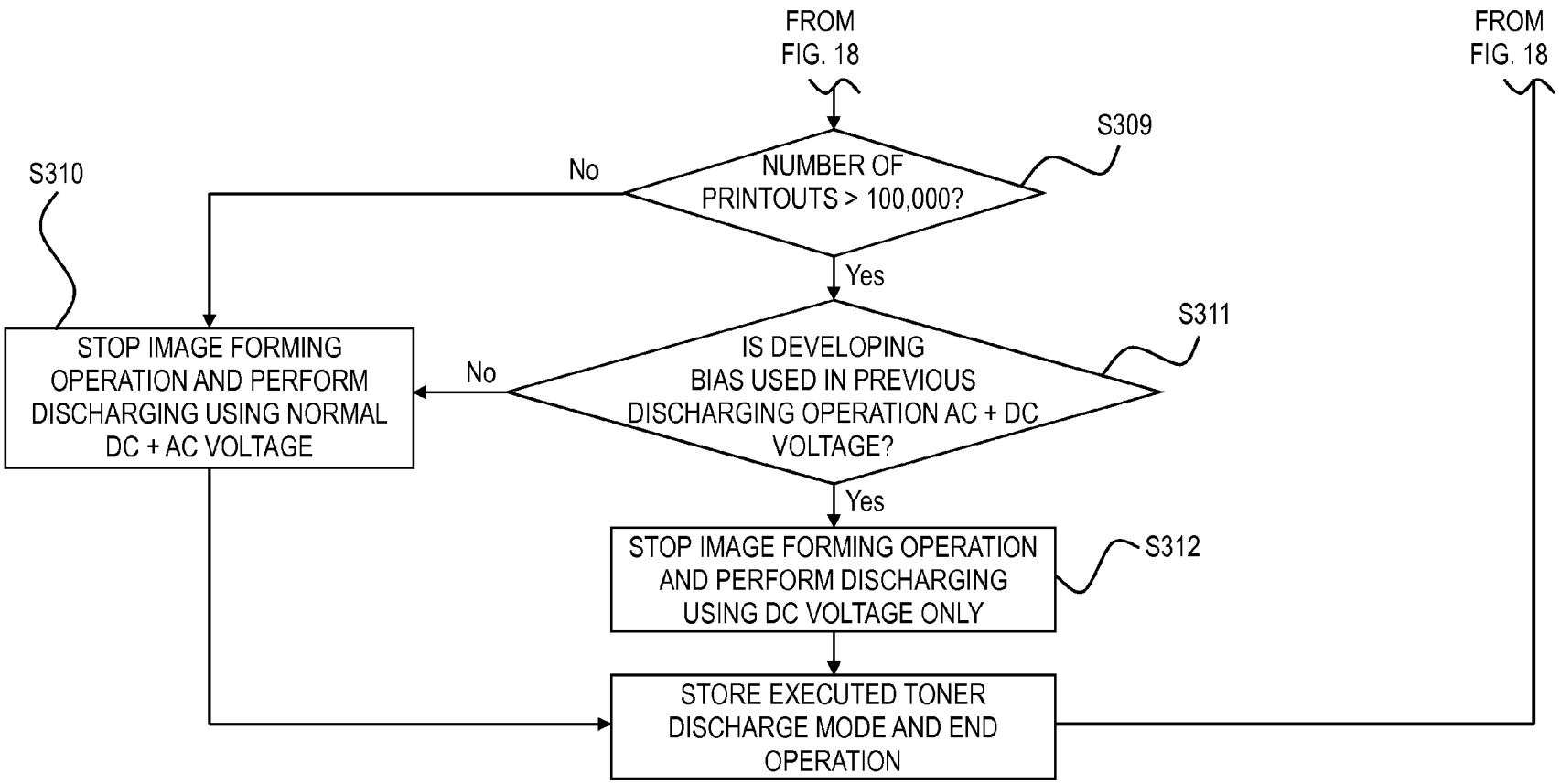

FIG. 18 is a flowchart of toner discharge control according to the second embodiment. Steps S301 to S307 are the same as steps S1 to S7 of FIG. 9 according to Reference Example 1.

As illustrated in FIG. 18, when it is determined in step S307 that (A−X) is negative, the number of printouts is checked (step S309).

When the number of printouts is equal to or smaller than 100,000 pages (predetermined number of pages), it is determined that it is relatively difficult for toner to scatter and the deteriorated toner discharge control mode is performed using a normal developing bias in which a DC voltage and an AC voltage are superimposed as in the image forming operation (step S310).

When the number of printouts exceeds 100,000 pages (predetermined number of pages), since toner can scatter easily, it is necessary to selectively execute the scattering toner discharge control mode using the DC voltage only or the deteriorated toner discharge control mode.

Here, the controller checks whether the previous discharging operation was performed using the DC voltage or the normal DC+AC voltage and determines which toner discharge mode is to be selected (step S311).

When the previous discharging operation is the deteriorated toner discharge control mode performed using the normal DC+AC voltage, the scattering toner discharge control mode is executed using the DC voltage only (step S312).

When the previous discharging operation is the scattering toner discharge control mode performed using the DC voltage only, the deteriorated toner discharge control mode is executed using the normal DC+AC voltage (step S310). When the discharging operation ends, the executed discharge control mode is stored and the operation ends.

As described above, in the present embodiment, by performing the toner discharge control using the developing bias in which a DC voltage and an AC voltage are superimposed and the toner discharge control using the DC voltage only, it is possible to suppress an image quality deterioration due to toner deterioration and the toner scattering.

In the present embodiment, although the scattering toner discharge control mode is performed instead of the deteriorated toner discharge control mode at the execution time for the deteriorated toner discharge control mode when the number of printouts exceeds 10,0000 pages, the present invention is not limited to this. For example, the thresholds for executing the scattering toner discharge control mode and the deteriorated toner discharge control mode may be provided separately so that the respective modes are performed independently.

Third Embodiment

An image forming apparatus according to a third embodiment will be described in detail. The same constituent components as those described above will be denoted by the same reference numerals, and the description thereof will not be provided.

The present embodiment proposes a more effective method of suppressing an image quality deterioration due to a toner deterioration and toner scattering.

In the present embodiment, the deteriorated toner discharge control mode only is executed when the number of printouts is small and the scattering toner amount is small, and the scattering toner discharge control mode is selectively performed using the DC voltage only according to the scattering toner amount when the number of printouts increases and toner can scatter easily, and the execution frequency of the scattering toner discharge control mode is increased whenever the number of printouts increases.

In the present embodiment, the number of printouts of 100,000 pages at which the scattering toner amount increases greatly in FIG. 14 is used as a threshold. The deteriorated toner discharge control mode only is performed when the number of printouts is equal to or smaller than 100,000 pages, and the scattering toner discharge control mode using the DC voltage only as well as the deteriorated toner discharge control mode is selectively performed while changing the execution frequency according to the number of printouts in FIG. 19 when the number of printouts exceeds 100,000 pages.

In the present embodiment, the controller 209 stores the records of at least past 10 operations on whether the toner discharge operation was performed based on the deteriorated toner discharge control mode using the DC+AC voltage or the scattering toner discharge control mode using the DC voltage only.

Figure 20:
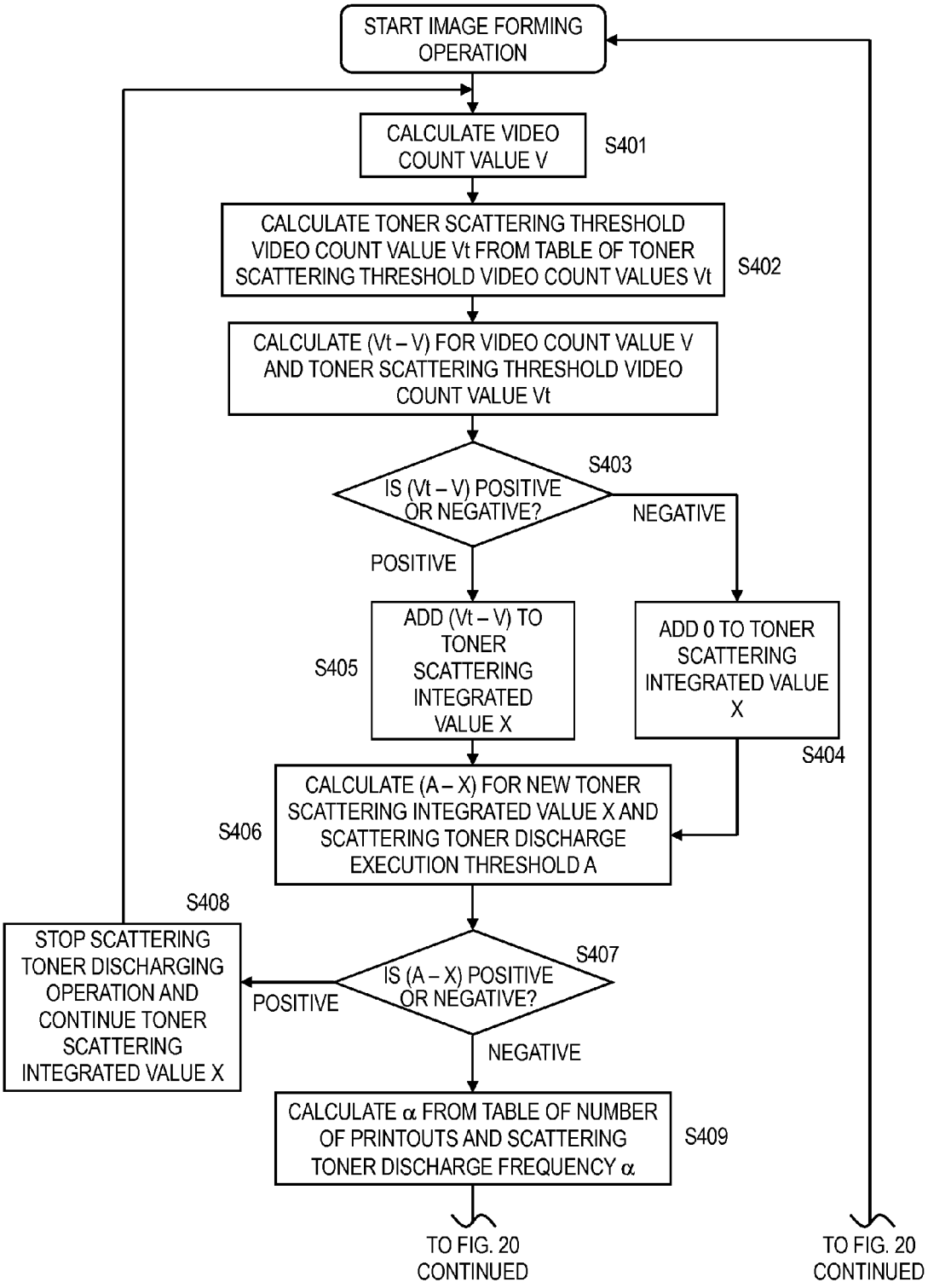
FIG. 20 is a flowchart of toner discharge control according to the third embodiment.
Figure 20:
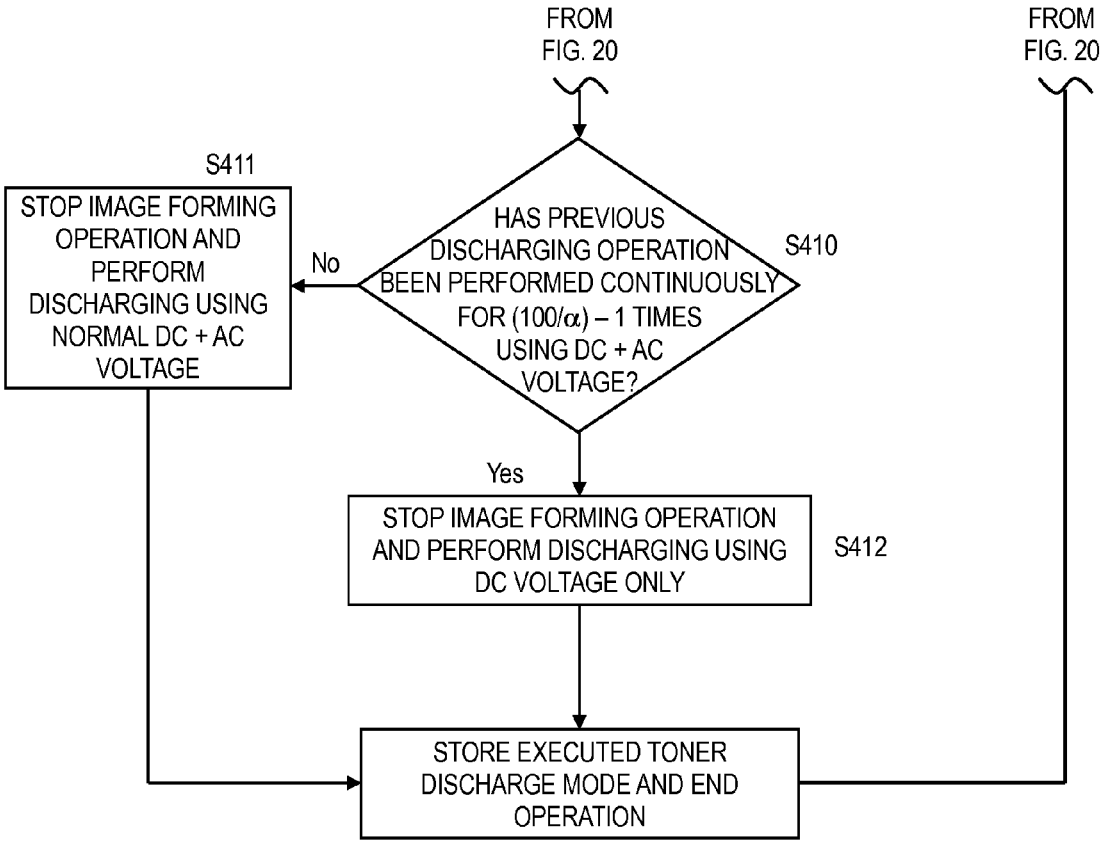

FIG. 20 is a flowchart of toner discharge control according to the third embodiment. Steps S401 to S407 are the same as steps S1 to S7 of FIG. 9 according to Reference Example 1.

As illustrated in FIG. 20, when it is determined in step S407 that (A−X) is negative, the number of printouts is checked and the scattering toner discharge frequency $\alpha$ is calculated from the table of the number of printouts and the scattering toner discharge frequency $\alpha$ of FIG. 19 (step S409).

It is checked whether the past toner discharging operation has been performed continuously for $(100/\alpha)-1$ times based on the deteriorated toner discharge control mode using the DC+AC voltage (step S410). When the deteriorated toner discharge control mode has not been performed continuously for $(100/\alpha)-1$ times ($\alpha \neq 0$) or $\alpha=0$, the deteriorated toner discharge control mode is performed using the DC+AC voltage (step S411). When the deteriorated toner discharge control mode has been performed continuously for $(100/\alpha)-1$ times ($\alpha \neq 0$), the scattering toner discharge control mode is performed using the DC voltage only in order to discharge scattering toner (step S412). After the discharging operation ends, the executed discharge control mode is stored and the operation ends.

As described above, in the present embodiment, by performing the toner discharge control using the developing bias in which a DC voltage and an AC voltage are superimposed and the toner discharge control using the DC voltage only, it is possible to more effectively suppress an image quality deterioration due to toner deterioration and the toner scattering according to a probability that the number of printouts increases and the toner can scatter easily.

Fourth Embodiment

An image forming apparatus according to a fourth embodiment will be described in detail. The same constituent components as those described above will be denoted by the same reference numerals, and the description thereof will not be provided.

The scattering toner amount depends greatly on the charged toner particles. In a high-humidity environment, electricity can discharge easily and the charges can drop easily so that the adhering force between the toner and carrier decreases and the toner can scatter more easily.

The present embodiment provides a more effective method of suppressing an image quality deterioration due to a toner deterioration and the toner scattering in a high-humidity environment where the scattering toner amount is large.

In the present embodiment, the deteriorated toner discharge control mode only is executed when the number of printouts is small and the scattering toner amount is small, and the scattering toner discharge control mode is selectively performed using the DC voltage only according to the scattering toner amount when the number of printouts increases and toner can scatter easily, and the execution frequency of the scattering toner discharge control mode is increased whenever the number of printouts increases as high as the humidity becomes.

In the present embodiment, the image forming apparatus includes a humidity detection portion that detects a humidity of the inside of the image forming apparatus.

Figure 22:
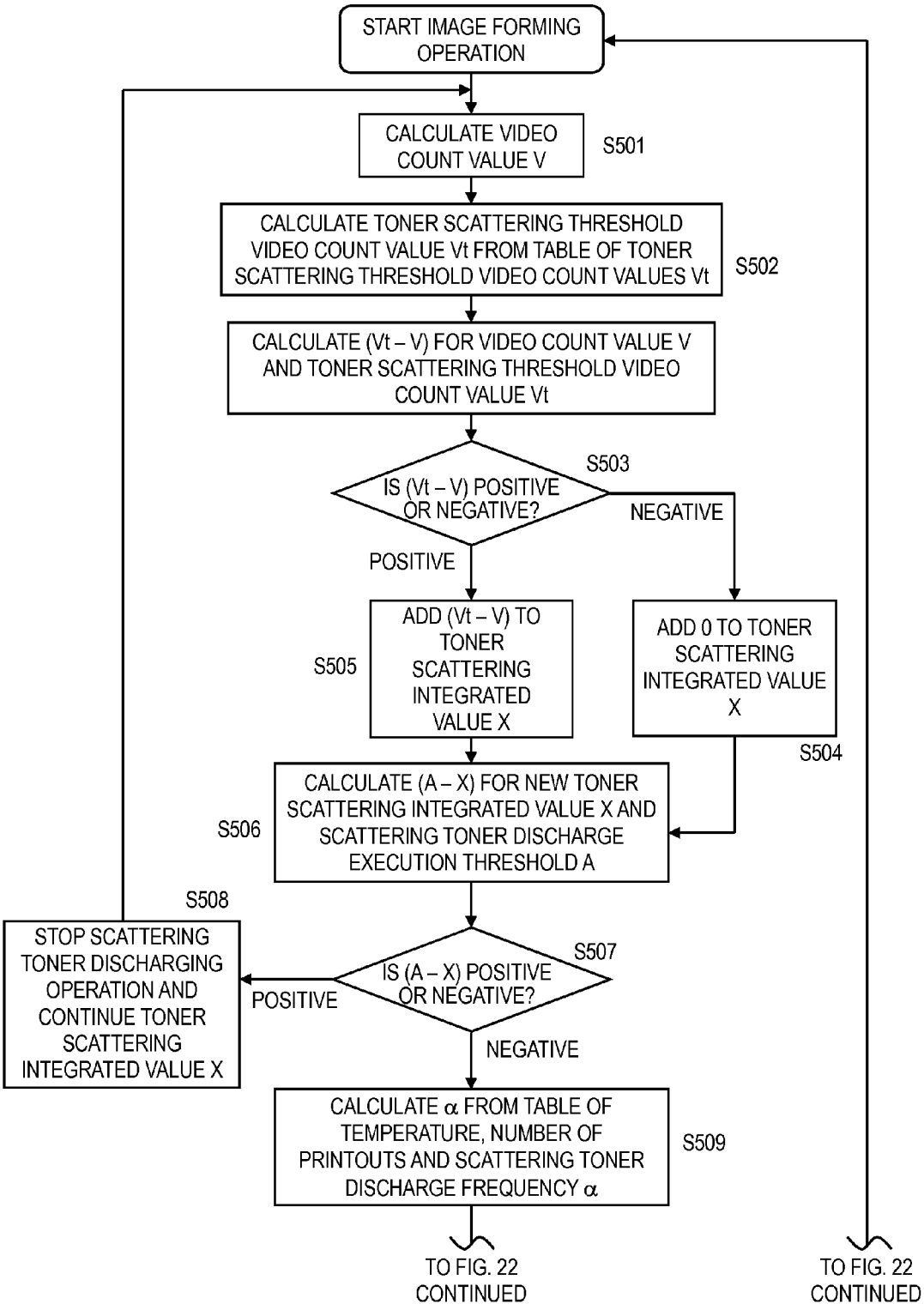
FIG. 22 is a flowchart of toner discharge control according to the fourth embodiment.
Figure 22:
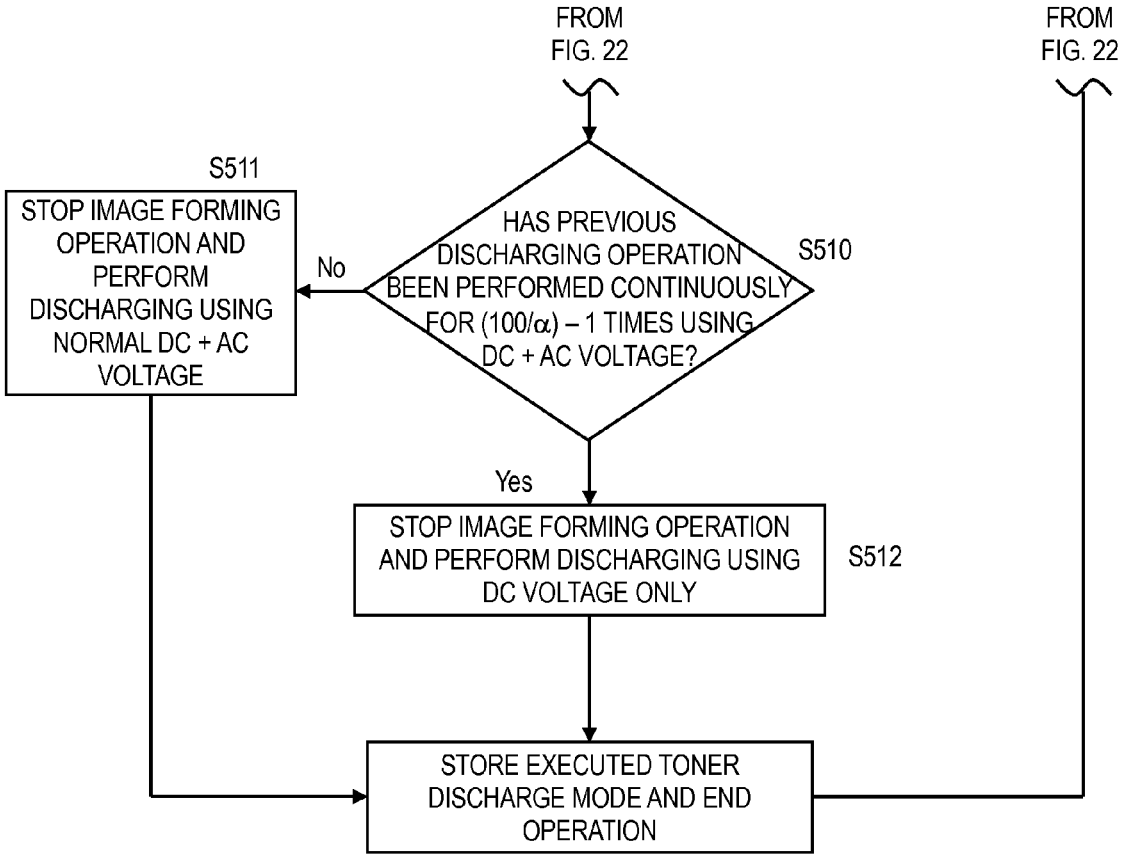

FIG. 22 is a flowchart of toner discharge control according to the fourth embodiment. Steps S501 to S507 are the same as steps S401 to S407 of FIG. 20 according to the third embodiment.

As illustrated in FIG. 22, when it is determined in step S507 that (A−X) is negative, the number of printouts and the humidity detected by the humidity detecting portion are checked and the scattering toner discharge frequency $\alpha$ is calculated from the table of the humidity and the scattering toner discharge frequency $\alpha$ of FIG. 21 (step S509). Steps S510 to S512 are the same as steps S410 to S412 of FIG. 20 according to the third embodiment.

As described above, in the present embodiment, by performing the toner discharge control using the developing bias in which a DC voltage and an AC voltage are superimposed and the toner discharge control using the DC voltage only according to a change in the scattering toner amount due to the humidity of the image forming apparatus and the number of printouts, it is possible to more effectively suppress an image quality deterioration due to toner deterioration and the toner scattering.

In the above-described embodiments, although a developing device that uses a two-component developer has been used, the present invention is not limited to this. The present invention can be applied to a developing device that uses a single-component developer (a single magnetic component or a single nonmagnetic component).

From the above, in the present invention, when a value correlated with a toner consumption amount is equal to or smaller than a predetermined value, the controller determines whether or not to execute the scattering toner discharge control mode based on integrated information of the information correlated with the toner consumption amount. Here, examples of the information correlated with the toner consumption amount include at least a video count value, a toner supply amount, a toner consumption amount (video count value) per unit sleeve driving period, and a print ratio, but the present invention is not limited to this.

In the present embodiment, when the scattering toner discharge control mode and the deteriorated toner discharge control mode are performed in parallel, although the discharge amount is sufficient as an amount of discharging scattering toner, the discharge amount may be insufficient as an amount of discharging deteriorated toner for purposes other than discharging scattering toner. In such a case, in a configuration where the deteriorated toner discharge control mode is simply substituted with the scattering toner discharge control mode as in the present embodiment, the discharge amount during the scattering toner discharge control mode may be increased to the same level as the deteriorated toner discharge control mode. However, in such a case, the downtime may increase. Thus, in the present embodiment, control may be performed so that the discharge period or the discharge amount in one deteriorated toner discharge control mode increases according to the interruption frequency of the scattering toner discharge control mode in order to compensate for the deficient discharge amount in the scattering toner discharge control mode.

According to the above configuration, it is possible to satisfactorily prevent toner scattering with an inexpensive configuration.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2013-066777, filed Mar. 27, 2013, which is hereby incorporated by reference herein in its entirety.

What is claimed is:

1. An image forming apparatus comprising:

an image bearing member;

a developing device that includes a developer bearing member rotatably provided so as to carry a developer and that develops an electrostatic latent image formed on the image bearing member;

a toner replenishing device that replenishes toner to the developing device; and a controller that is capable of forming an image by applying a voltage in which a DC voltage and an AC voltage are superimposed to the developer bearing member, wherein the controller is capable of executing a first control mode in which the DC voltage only is applied to the developer bearing member during a non-image forming period, which is a period that an image is not formed on a recording material, based on information on a toner consumption amount so that toner moves from the developer bearing member to the image bearing member, the controller is capable of executing a second control mode in which at least the AC voltage is applied to the developer bearing member during the non-image forming period based on the information on the toner consumption amount so that toner moves from the developer bearing member to the image bearing member, and the controller performs control so that at least the first control mode and the second control mode are selectively executed according to information on a number of printouts of the recording material.

2. The image forming apparatus according to claim 1, wherein the controller executes only the second control mode when the number of printouts is equal to or smaller than a predetermined number of pages, and selectively executes the second control mode and the first control mode when the number of printouts exceeds the predetermined number of pages.

3. The image forming apparatus according to claim 1, wherein the controller increases an execution frequency of the first control mode and decreases an execution frequency of the second control mode as the number of printouts increases according to the information on the number of printouts.

4. The image forming apparatus according to claim 1, wherein the controller executes the first control mode based on integrated information of information correlated with the toner consumption amount when a value correlated with the toner consumption amount is equal to or smaller than a predetermined value.

5. The image forming apparatus according to claim 4, wherein the predetermined value is set to increase with an increase in the number of printouts of the recording material.

* * * * *